US012599248B2

(12) United States Patent
de Jong

(10) Patent No.: US 12,599,248 B2
(45) Date of Patent: Apr. 14, 2026

(54) SYSTEMS AND METHOD FOR ELIMINATING AIRBORNE CONTAMINANTS

(71) Applicant: AirTulip Inc., New York, NY (US)

(72) Inventor: Arjen de Jong, New York, NY (US)

(73) Assignee: AirTulip Inc., New York, NY (US)

( * ) Notice: Subject to any disclaimer, the term of this patent is extended or adjusted under 35 U.S.C. 154(b) by 0 days.

(21) Appl. No.: 18/708,147

(22) PCT Filed: Nov. 8, 2022

(86) PCT No.: PCT/US2022/049256
§ 371 (c)(1),
(2) Date: May 7, 2024

(87) PCT Pub. No.: WO2023/081506
PCT Pub. Date: May 11, 2023

(65) Prior Publication Data

US 2024/0341493 A1 Oct. 17, 2024

Related U.S. Application Data

(60) Provisional application No. 63/276,678, filed on Nov. 8, 2021.

(51) Int. Cl.
*A47C 21/04* (2006.01)
*A47C 19/02* (2006.01)
(Continued)

(52) U.S. Cl.
CPC ..... *A47C 21/044* (2013.01); *A47C 19/022* (2013.01); *F24F 5/0096* (2013.01);
(Continued)

(58) Field of Classification Search
CPC .... A47C 21/044; A47C 19/022; F24F 5/0096; F24F 8/10; F24F 13/24; F24F 2130/40
See application file for complete search history.

(56) References Cited

U.S. PATENT DOCUMENTS 3,908,655 A * 9/1975 Lund ..... A61M 19/00 604/23
4,821,349 A * 4/1989 Cohen ..... A47C 19/022 5/183
(Continued)

FOREIGN PATENT DOCUMENTS

CN 2446973 Y * 9/2001
CN 204120614 U 1/2015
(Continued)

OTHER PUBLICATIONS

International Search Report and the Written Opinion of the International Searching Authority issued for International Application No. PCT/US22/49256, dated Feb. 16, 2023.
(Continued)

*Primary Examiner* — Dung H Bui
(74) *Attorney, Agent, or Firm* — Myers Wolin, LLC

(57) ABSTRACT

An apparatus is provided for removing airborne contaminants from a defined space above a bed. The apparatus includes a headboard having an air flow outlet adjacent to the defined space and an air flow inlet incorporated into the bed or the headboard outside of the defined space. The apparatus then provides a conduit for transporting air from the inlet to the outlet, an air treatment module within or adjacent the conduit for extracting air-borne contaminants from air transported from the air flow inlet to the air flow outlet, and an air flow generator within or adjacent the conduit for generating air flow between the air flow inlet and the air flow outlet. The air flow outlet then has a plenum within the headboard, and the plenum deposits air into the defined space through an outlet area having a porous surface, the outlet area being otherwise substantially unobstructed.

21 Claims, 14 Drawing Sheets

(51) Int. Cl.

| | |
|---|---|
| ***F24F 5/00*** | (2006.01) |
| ***F24F 8/10*** | (2021.01) |
| ***F24F 13/24*** | (2006.01) |
| *F24F 130/40* | (2018.01) |

(52) U.S. Cl.
CPC ..... *F24F 8/10* (2021.01); *F24F 13/24* (2013.01); *F24F 2130/40* (2018.01)

(56) References Cited

U.S. PATENT DOCUMENTS

| | | | | |
|---|---|---|---|---|
| 5,383,635 | A * | 1/1995 | Barone | A47B 13/00 108/150 |
| 5,520,021 | A * | 5/1996 | Clerici | D04B 21/02 66/193 |
| 5,730,120 | A * | 3/1998 | Yonkers, Jr. | A47C 21/044 128/202.13 |
| 5,887,452 | A * | 3/1999 | Smith | D04B 1/22 66/196 |
| 5,926,874 | A * | 7/1999 | Browder | A47C 21/028 5/482 |
| 6,155,647 | A * | 12/2000 | Albecker, III | A47C 1/146 297/228.12 |
| 6,261,332 | B1 * | 7/2001 | Richard | B01D 46/121 55/486 |
| 6,425,821 | B1 * | 7/2002 | Koerber | F24F 13/068 454/906 |
| 7,438,361 | B1 * | 10/2008 | Huang | A47C 7/40 297/452.56 |
| 7,543,583 | B2 * | 6/2009 | Acton | A61G 7/05 5/423 |
| 8,122,540 | B2 * | 2/2012 | Ardis | A47C 21/044 5/284 |
| 8,414,671 | B2 | 4/2013 | Augustine et al. | |
| 9,456,700 | B2 * | 10/2016 | Greener | A47C 21/044 |
| 10,034,550 | B2 | 7/2018 | Rydsund | |
| 10,542,825 | B1 * | 1/2020 | Antinori | A47C 27/20 |
| 11,045,011 | B2 * | 6/2021 | Venditto | A47C 21/048 |
| 11,273,087 | B1 * | 3/2022 | Mokhtar | A61G 13/04 |
| 11,707,706 | B1 * | 7/2023 | Bhate | F24F 8/10 95/273 |
| 2003/0033790 | A1 | 2/2003 | Hague | |
| 2003/0153260 | A1 | 8/2003 | Kristensson | |
| 2003/0203114 | A1 * | 10/2003 | Nash | D06N 7/0092 428/196 |
| 2004/0158920 | A1 * | 8/2004 | Walling | A47C 31/002 5/2.1 |
| 2006/0079170 | A1 | 4/2006 | Schmid et al. | |
| 2007/0035165 | A1 * | 2/2007 | Zahel | B60N 2/5825 297/228.11 |
| 2007/0134464 | A1 * | 6/2007 | Schindzielorz | B32B 5/026 428/86 |
| 2008/0150334 | A1 * | 6/2008 | Callaghan | A47C 31/11 297/218.3 |
| 2008/0187147 | A1 * | 8/2008 | Berner | G10K 11/17823 381/71.3 |
| 2010/0005588 | A1 * | 1/2010 | Christopher | A47C 31/123 5/423 |
| 2013/0031722 | A1 * | 2/2013 | Wong | A47C 21/044 5/423 |
| 2013/0227785 | A1 * | 9/2013 | Clay | A47G 9/0253 139/11 |
| 2013/0295812 | A1 * | 11/2013 | Lee | D04B 1/22 66/196 |
| 2015/0272338 | A1 | 10/2015 | Greener | |
| 2016/0066699 | A1 * | 3/2016 | Rydsund | A47C 19/022 181/224 |
| 2017/0191682 | A1 * | 7/2017 | King | F24F 5/0035 |
| 2017/0367497 | A1 * | 12/2017 | Waters | A47D 9/00 |
| 2018/0134193 | A1 * | 5/2018 | Yang | B60N 2/5642 |
| 2018/0142717 | A1 * | 5/2018 | Ejdemo | A47C 4/028 |
| 2019/0290132 | A1 * | 9/2019 | Au | A61B 5/6892 |
| 2019/0298072 | A1 * | 10/2019 | Bhatia | B60N 2/565 |
| 2020/0171807 | A1 * | 6/2020 | Hsieh | B32B 7/12 |
| 2020/0306128 | A1 * | 10/2020 | Turner | A61G 7/0506 |
| 2023/0064841 | A1 * | 3/2023 | Abohashem | A61G 7/0524 |
| 2023/0372174 | A1 * | 11/2023 | Svensson | A61G 13/108 |

FOREIGN PATENT DOCUMENTS

| | | | |
|---|---|---|---|
| CN | 205994086 | U | 3/2017 |
| CN | 113662386 | A | 11/2021 |
| FR | 1448873 | A | 6/1965 |
| JP | 2007-202682 | A | 8/2007 |
| JP | 2011-202907 | A | 10/2011 |
| JP | 2012-002393 | A | 1/2012 |

OTHER PUBLICATIONS

Pure Air Zone Headboard, Pure Air Zone, retrieved from the Internet Jul. 9, 2022.

* cited by examiner

SYSTEMS AND METHOD FOR ELIMINATING AIRBORNE CONTAMINANTS

CROSS-REFERENCE TO RELATED APPLICATION

This application is a U.S. national stage entry, under 35 U.S.C. § 371, of International Application No. PCT/US2022/049256, filed Nov. 8, 2022, which takes priority from U.S. Provisional Patent Application No. 63/276,678 filed Nov. 8, 2021, the contents of each of which are incorporated by reference herein in their entirety.

FIELD OF THE INVENTION

The present invention relates to air ventilation and treatment systems.

BACKGROUND

In scenarios where undesirable airborne particles exist, there is a risk that people might breathe those particles. Various restrictions might be implemented and certain risks may be known.

Modern ventilation and purification devices typically operate air streams that quickly mix with surrounding flow and ambient air. Filtering alone cannot control the origin of the air around a person, as there can be no certainty that the air being breathed originated at the filter.

There is a need for ways to enable protection for a subject from airborne contaminants. This may be by controlling the localized flow of air and treatment thereof. This is particularly acute in situations where subjects are in a specific location for a long period of time, such as when subjects are in bed.

The need is similarly particularly acute for subjects having particular sensitivities or risks associated with exposure to contaminants and low quality air. It would for example be beneficial for people with allergies, asthma, pollen sensitivity, sensitivity to bad air quality, forest fire smoke and the like to be provided with purified air that remains independent of ambient air. Such an approach also will aid in prevention of deceases such as airborne virus or bacteria loads.

When people sleep or rest, the positioning of the breathing zone is contained. This would enable a method to control the air locally.

There is therefore a need for an apparatus that can control the air quality of a breathing zone around a user while they sleep.

SUMMARY

This disclosure relates to systems compromising one or more flow control elements encompassing at least part of a space having an air treatment system, in which a zone of controlled and treated air is created around subjects. Several embodiments and elements are depicted in different levels of detail.

In some embodiments, an apparatus for removing airborne contaminants from a defined space above a bed is provided. The apparatus includes a headboard for a bed having an air flow outlet adjacent to the defined space and an air flow inlet incorporated into the bed or the headboard outside of the defined space.

The apparatus then provides a conduit for transporting air from the air flow inlet to the air flow outlet, an air treatment module within or adjacent the conduit for extracting airborne contaminants from air transported from the air flow inlet to the air flow outlet, and an air flow generator within or adjacent the conduit for generating air flow between the air flow inlet and the air flow outlet.

The air flow outlet then comprises a plenum within the headboard, and the plenum deposits air into the defined space through an outlet area having a porous surface, the outlet area being otherwise substantially unobstructed.

In some such embodiments, the outlet area defines an area for a plug flow, such that the area when extruded contains a breathing zone within the defined space, and wherein the plug flow extends perpendicular to a front surface of the headboard into the breathing zone.

In some such embodiments, the breathing zone is adjacent a sleeping surface of the bed, and a lower edge of the outlet area is aligned with an edge of the sleeping surface.

In some such embodiments, the headboard has an upper edge and the outlet area has an upper edge, and the upper edge of the outlet area is spaced apart from the upper edge of the headboard.

In some such embodiments, the outlet area is adjustable by moving the upper edge of the outlet area closer or farther from the headboard. In some such embodiments, the position of the upper edge is selected based on a height of a user's head while on the bed.

In some embodiments, the defined space is adjacent a sleeping surface of the bed. A lower edge of the outlet area may then be adjustable such that it can be aligned with a top of a mattress, pillow, or bedspread on the sleeping surface of the bed.

In some embodiments, the defined space is adjacent a sleeping surface of the bed, and an upper edge of the outlet area is curved, such that it has a peak adjacent an expected head location of a user.

In some embodiments, the headboard extends at an angle relative to a vertical direction. Accordingly, when the plug flow extends perpendicular to the front surface of the headboard, the plug flow extends at an angle relative to the horizontal direction.

In some such embodiments, the angle relative to the vertical direction is small enough to prevent separation between the plug flow and a sleeping surface of the bed.

In some such embodiments, an upper edge of the outlet area is located such that an expanding shear layer formed above the upper edge of the plug flow remains above a user's head during use by a threshold amount. In some such embodiments, the upper edge of the outlet area is at a height insufficient to provide the threshold amount of clearance, but wherein the defined space extends upwards after leaving the outlet area due to the angle of the headboard.

In some embodiments, the plenum comprises rigid supports for supporting a housing of the headboard. The rigid supports then frame the outlet area, such that the substantially unobstructed area is not obstructed with supports.

In some embodiments, the porous surface comprises at least a portion of the air treatment module.

In some embodiments, the plenum comprises a flow aligned support structure supporting the plenum at the outlet area. In some such embodiments, the plenum comprises additional supports that are not flow aligned that frame the unobstructed area.

In some such embodiments, the outlet area comprises two distinct outlet segments. Additional supports that are not flow aligned then divide the two distinct outlet segments. In some such embodiments, the two distinct outlet segments are independently controllable.

In some embodiments, the flow aligned support structure has sufficient depth to at least partially define a direction of the flow. In some such embodiments, the outlet area defines an area for a plug flow such that the area when extruded corresponds to the defined space, and wherein the plug flow extends in a direction defined by the flow aligned support structure. In some such embodiments, the direction defined by the flow aligned support structure is distinct from a direction perpendicular to a front surface of the headboard.

In some embodiments, the plenum includes a support structure, and the porous surface is fixed to the support structure. The support structure then comprises support elements that are sufficiently narrow or flow aligned so as to not obstruct air flow.

In some such embodiments, the porous surface is a padded fabric surface, and the fabric surface is stitched to the support structure at visible seams. In some such embodiments, the support elements are tension elements, and the visible seams are positioned symmetrically along the headboard for visual effect.

In some embodiments, support components of the support structure are fully contained within the outlet area and do not extend to a top or side edge of the outlet area.

In some embodiments, the air treatment module includes an oxygenation module for increasing an oxygen level in at least a portion of the air flow deposited into the defined space.

In some such embodiments, a plurality of air treatment modules are provided, and a first of the plurality of air treatment modules increases an oxygen level in the at least a portion of the air flow deposited into the defined space, and a second of the plurality of air treatment modules does not increase an oxygen level in a second portion of the air flow deposited into the defined space.

In some embodiments, the air flow generator are incorporated into a base of the headboard below a height of a top surface of the bed.

In some such embodiments, a space between a front surface of the plenum and the air flow generator is obstructed by an obstruction, such that air from the air flow generator passes around the obstruction prior to entering the plenum.

In some such embodiments, the obstruction obstructs any line of sight from the plenum to the air flow generator.

In some embodiments, the obstruction comprises a sequence of baffles for obstructing airflow.

In some embodiments, the apparatus includes a secondary plenum positioned between the air flow generator and the obstruction, such that air flow from the air flow generator is deposited into the secondary plenum and then proceed from the secondary plenum to the plenum.

In some such embodiments the secondary plenum comprises an air distribution module having vanes, and the air distribution module determines a distribution of air deposited into the plenum from the secondary plenum.

In some embodiments having a secondary plenum and an obstruction, the obstruction is between the secondary plenum and the plenum. In some such embodiments, the obstruction comprises a movable panel, and a configuration of the movable panel within the headboard defines a route taken by air flow from the air flow generator. In some such embodiments, the configuration of the movable panel determines a level of pressure within the plenum and a level of noise detectable outside the headboard.

In some embodiments having a panel type obstruction, movement of the movable panel is passive and is responsive to a setting of the air flow generator.

In other embodiments, movement of the movable panel is actively controlled by a controller in order to balance pressure levels within the plenum against noise levels detectable outside the headboard.

In some such embodiments, the apparatus includes at least one noise sensor, and the movable panel is adjusted by the controller in order to maintain the level of noise below a threshold.

In some such embodiments, the controller further controls the air flow generator, and upon adjusting the movable panel to reduce noise levels, the controller increases an output of the air flow generator to maintain air flow at a desired level.

In some embodiments, the air flow generator pressurizes the secondary plenum which in turn controls pressure levels in the plenum.

In some such embodiments, the air flow generator is a centrifugal fan, and a centrifugal wheel of the centrifugal fan is within the secondary plenum.

In some embodiments, the air flow generator is a centrifugal fan with oversized blades turning at a slow rate of rotation.

In some embodiments, the air flow generator is a centrifugal fan with an axial intake. The air flow from the air flow inlet is then directed to the axial intake in a conduit having a direction substantially perpendicular to an axis of the centrifugal fan. The axial intake is spaced apart from a back wall by a first distance. In some such embodiments, the air flow generator further includes a guide element for redirecting air flow in the conduit so that portions of the air flow approach the axial intake from directions other than the direction of the conduit.

In some such embodiments, the guide element is a porous or perforated cylindrical shroud that extends across the first distance, such that air flow that enters the axial intake first passes through the cylindrical shroud.

In some embodiments, the guide element comprises a plurality of vanes for directing air flow substantially evenly about the axial intake.

In some embodiments, the air treatment module includes a filtration unit adjacent the porous surface, where the air treatment module does not obstruct airflow.

Also provided is a fan assembly. Such an assembly includes a centrifugal outlet, an axial intake, and an intake conduit extending substantially perpendicular to the axial intake. The assembly further includes a guide element for redirecting air flow adjacent the axial intake. The axial intake is spaced apart from a back wall of the intake conduit by a first distance, and the guide element redirects air flow such that portions of the air flow approach the axial intake from directions other than a direction of the intake conduit.

In some such embodiments, the guide element is a porous or perforated cylindrical shroud that extends across the first distance, such that air flow that enters the axial intake first passes through the cylindrical shroud.

In some embodiments, the guide element comprises a plurality of vanes for directing air flow substantially evenly about the axial intake.

DETAILED DESCRIPTION OF THE PREFERRED EMBODIMENTS

Figure 1A:
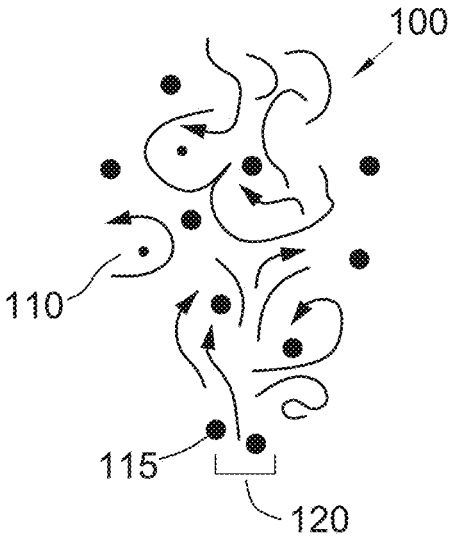
FIGS. 1A-1D illustrate various flow principles related to this disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Terminology used here is for purpose of describing particular embodiments and is not intended to be limiting the invention. Singular forms mentioned are intended to include plural forms as well as singular forms. And/or refers to any and all possible combinations of all listed types, including none. The term Subject or Person can refer to medical patients but also non-medical persons, and can include living animals as well. Any depicted orientation of the Person is not unique and unless explicitly mentioned can be exchanged for other postures and positions.

The present invention will now be described by referencing the appended figures. Generally, in the embodiments described herein, an isolated zone of controlled air is created in the open, in order to create a targeted breathing zone of controlled air for a subject, also referred to herein as a user. The embodiments described herein are generally in the context of the integration of such a device into a headboard for a bed.

The flow principles related to the embodiments described herein are based on non-mixing laminarized or low-turbulence flow. In some embodiments described below, different types of air treatment can be incorporated into the headboard integration. That may include particulate filtering, gas filtering, heating, cooling, humidity control, oxygen control, injection or removal of other gasses, powders, scents, and ions.

FIGS. 1A through 1D illustrate elements of key flow principles used by systems and methods of the current disclosure: the minimization of shear, and/or the laminarization of flow. Turbulent flow 100, as shown in FIG. 1A, causes rapid mixing 110 of contaminants 115 from a source 120 and aids in spreading such contaminants.

Figure 1B:
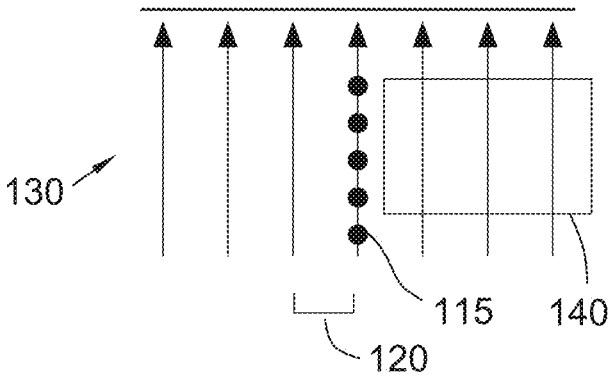

A laminar flow 130, as shown in FIG. 1B, does not do this. Instead, laminar flow 130 allows for the creation of a shielded zone 140 in which a source of the air flow can be controlled and distinct from the source 120 of contaminants 115. Speed differences, or velocity gradients, in the flow 150, such as those due to shear and rotation (but not due to divergence) can cause the generation of instabilities that break down into turbulence, effectively being the energy source for cascading eddies. However, in order to maintain laminar flow 130, a uniform profile is needed to remove as much as possible the driving shear that is the engine for formation and sustaining of mixing eddies/whirls.

Figure 1C:
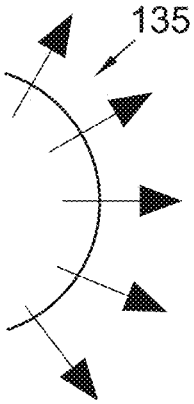

A similar approach may work with a curved surface, as shown in FIG. 1C, resulting in laminar flow 135 that expands, so long as the curvature of the surface is not too extreme.

Existing devices typically use a jet-like flow with a high velocity over a relatively small area which would immediately generate turbulence 100. In such embodiments, mixing 110 dominates, and in a short distance relative to the width of the jet, the airflow is fully turbulent, as shown in FIG. 1A. Instead, if the flow 150 is much slower, and relative flows of distinct portions of the flow 160, 170 are relatively similar and over a larger area, a designated isolated zone can stay laminar and/or low-turbulence.

Each portion of the flow 160, 170 then results in a corresponding flow zone having an interface 180 at which some mixing occurs in a shear layer. The shear layer at the interface 180 eventually expands into a shear cone 190 with turbulent flow 195 that generates mixing and that increases in size downstream.

Figure 1D:
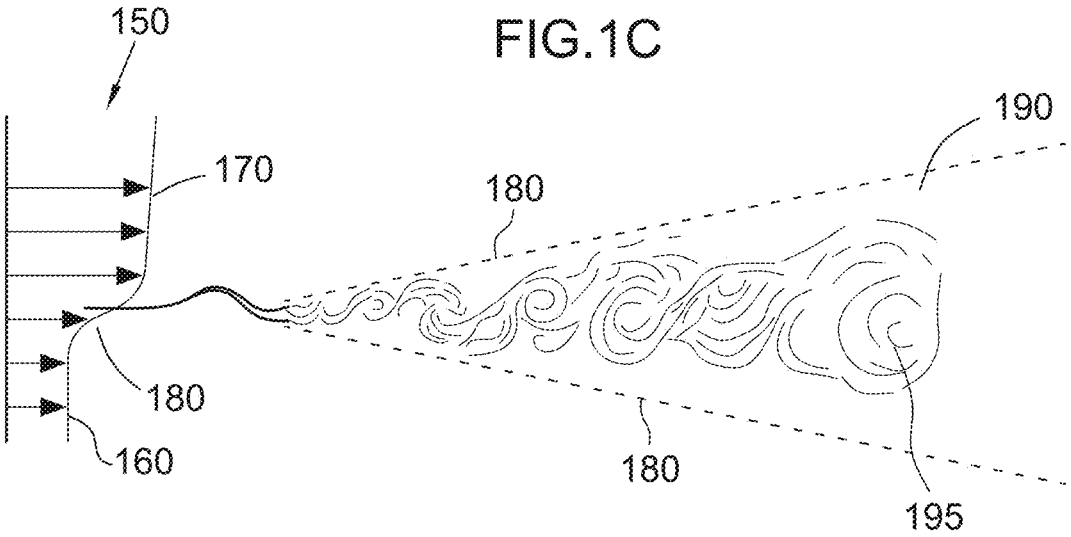

The slower moving plug flow shown in FIG. 1D has lower shear and the shear of the edges is further away from the center, enabling the creation of a relatively steady bubble with low mixing and a controlled flow direction adjacent the shear cone 190.

Separation of flow and backflow increases mixing at edges. In some embodiments, such separation and backflow is avoided by controlling the angle of a plug flow along a surface. Moreover, shielding can be designed based on recognizing that divergence in the relative absence of shear or vorticity can aid in effective shielding.

Figure 2A:
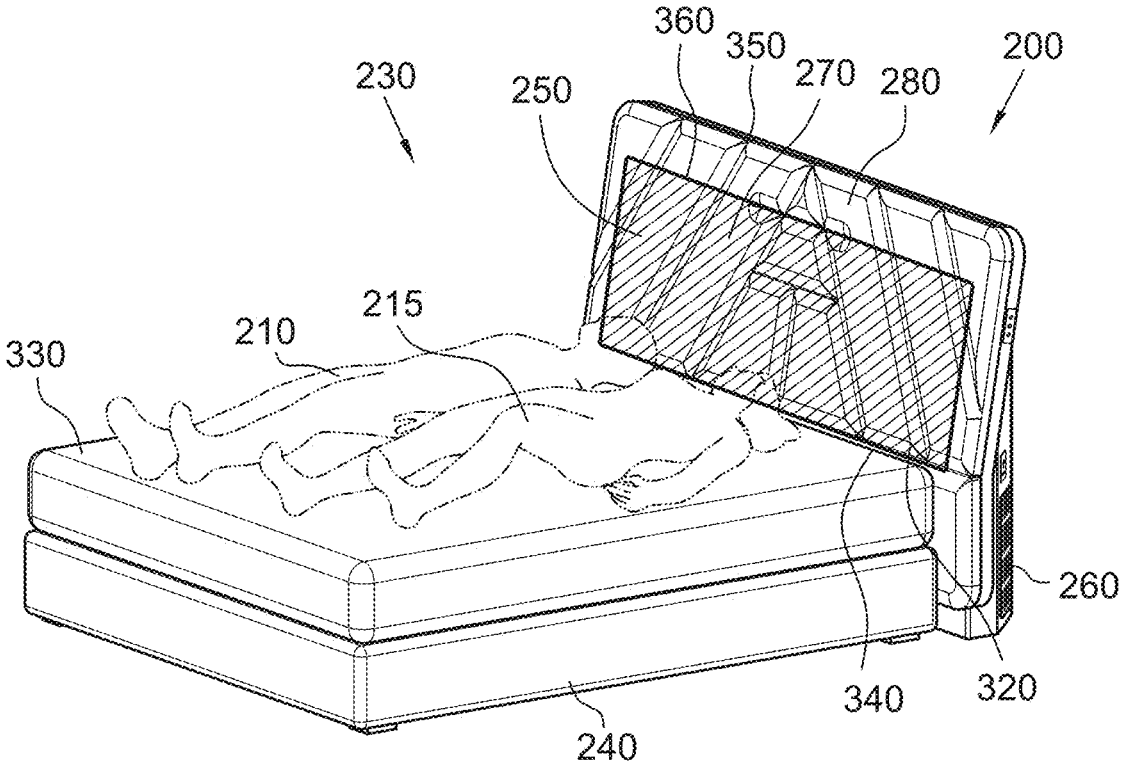
FIG. 2A illustrates an apparatus in accordance with this disclosure adjacent a bed.

FIG. 2A illustrates an apparatus 200 in accordance with this disclosure adjacent a bed 240, occasionally referred to herein as the bedhead form.

Figure 2B:
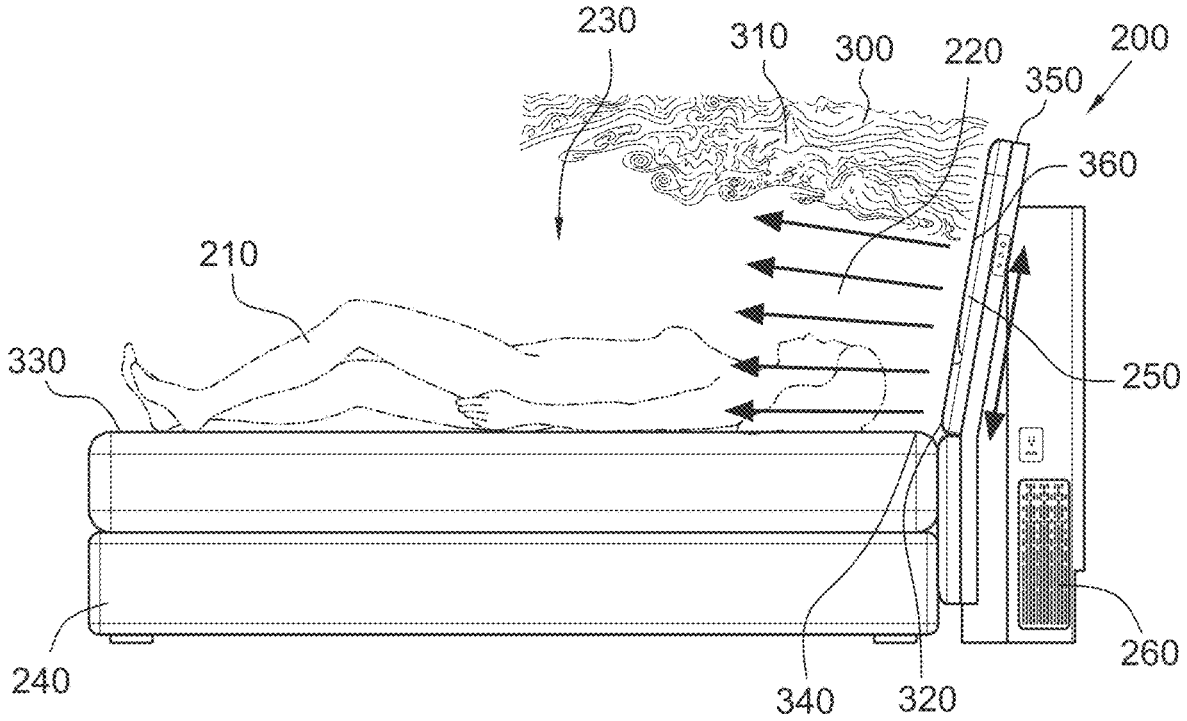
FIGS. 2B and 2C illustrate use of the apparatus of FIG. 2A to remove airborne contaminants from a defined space.
Figure 2C:
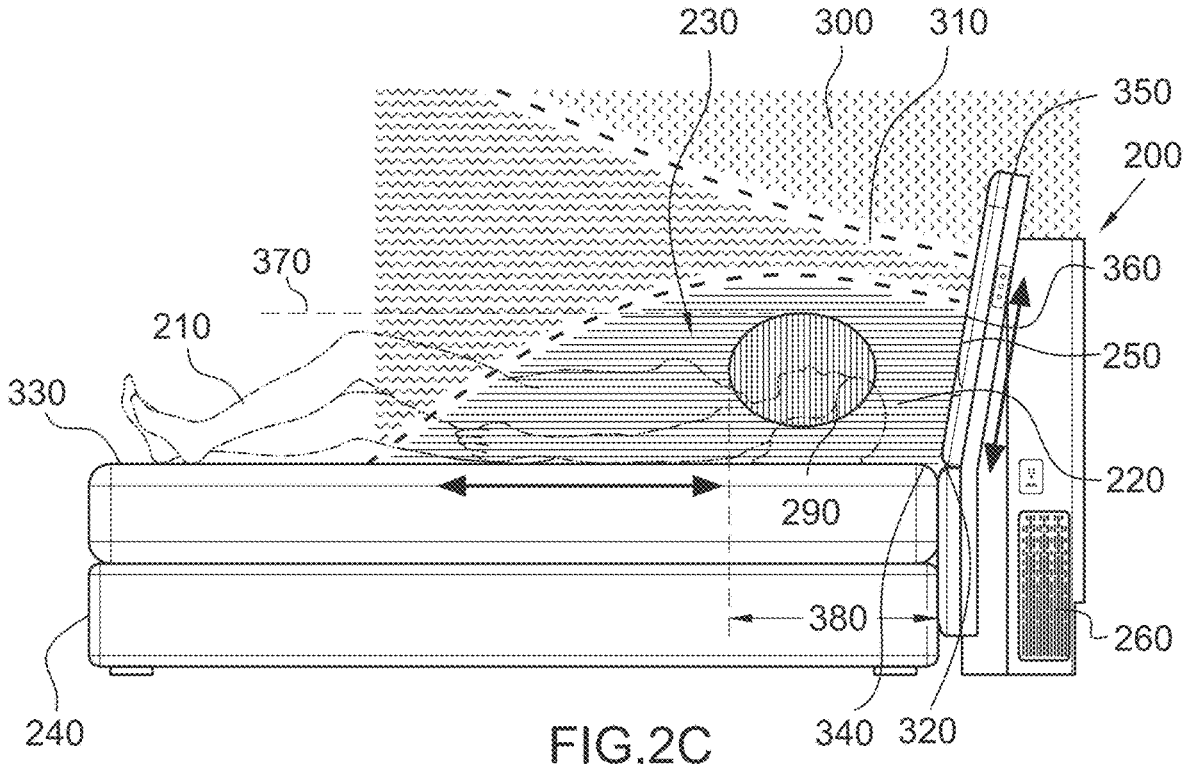

FIGS. 2B and 2C illustrate use of the apparatus 200 of FIG. 2A to remove airborne contaminants from a defined space.

Accordingly, FIGS. 2A-2C show an example embodiment of a system integration in a bedframe headboard 200 for the purpose of controlling airflow and air cleanliness around the heads of sleeping subjects, or users 210, 215. Accordingly, the headboard 200 outputs laminarized and filtered airflow 220 that flows past one or more users 210.

Accordingly, as shown, the apparatus is provided for removing airborne contaminants from a defined space 230 above the bed 240. In the embodiment shown, the apparatus 200 comprises the headboard itself, including a headboard base, which includes an air flow outlet 250 adjacent to the defined space 230 and an air flow inlet 260 incorporated into the bed 240 or the headboard 200 outside of the defined space 230. The apparatus 200 may be referred to herein as headboard 200.

It is noted that in some embodiments, discussed in more detail below, the headboard 200 is a portion of the fully contained apparatus. In such embodiments, the headboard may be the portion of the apparatus adjacent the bed 240, such as the plenum, and may be independent of a base, for example.

As discussed in more detail below, the apparatus 200 also provides a conduit for transporting air from the air flow inlet 260 to the air flow outlet 250 and an air treatment module within or adjacent the conduit for extracting airborne contaminants from the air transported. The apparatus also includes an air flow generator, such as a fan, within or adjacent the conduit for generating air flow between the air flow inlet 260 and the air flow outlet 250.

The air flow outlet 250 typically comprises a plenum within the headboard, and the plenum deposits air into the defined space 230 through an outlet area 270 having a porous surface. Other than the porous surface itself, as well as any portion of the air treatment module incorporated into the outlet, the outlet area 270 is typically substantially unobstructed. Accordingly, the porous surface may comprise at least a portion of the air treatment module, such as a filtration layer, but the outlet area would be otherwise substantially unobstructed. However, as discussed below, in some embodiments, the outlet area 270 may be divided into multiple distinct zones, such as zones allocated to different users 210.

Accordingly, the headboard 200 housing, or a portion of the headboard housing, may function as a plenum body, and the porous surface of the outlet area 270 may be a diffuser to create a controlled laminarized or low-turbulence directed plug flow 220. As such, a significant portion of the front surface 280 of the headboard 200 itself may comprise the porous surface of the outlet area 270, and may thereby introduce laminarized airflow with reduced shear and rotation that is substantially uniform over the outlet area.

Accordingly, the outlet area 270 defines an area for plug flow, such that the area, when extruded, includes a breathing zone 290 within the defined space 230. In some embodiments, such as that shown, the plug flow then extends perpendicular to the front surface 280 of the headboard 200 into the breathing zone 290.

As noted above with respect to FIG. 1D, the velocity gradients between distinct portions of the flow 160, 170 eventually lead to an interface 180 at which some mixing occurs in a shear layer. Accordingly, because the directed plug flow 220 is moving at a different velocity than ambient air 300, a shear cone 310 of mixing air typically forms at an upper edge of the defined space 230 which is adjacent ambient air 300 of the room in which the headboard 200 is used.

In order to prevent such a velocity gradient at the bottom of the plug flow 220, the size and shape of the outlet area 270 may be controlled. In some embodiments, the breathing zone 290 is located adjacent a sleeping surface 330 of the bed 240, and a lower edge 320 of the outlet area is deliberately aligned with an edge 340 of the sleeping surface.

Typically, the headboard 200 has an upper edge 350 and the outlet area 270 has an upper edge 360, and the upper edge of the outlet area is spaced apart from the upper edge of the headboard. The upper edge 360 of the outlet area 270 is located such that the shear cone 310 of mixing air remains above the breathing zone 290, such that the breathing zone remains free of contaminants from the ambient air 300.

The breathing zone 290 may be designed for a height of the user's 210 head when lying in the bed 240, as well as a distance from the headboard 200 that would enclose reasonable locations for the user's head. Accordingly, the position of the upper edge 360 of the outlet area 270 may be selected based on a height of a user's 210 head while in a bed, so as to provide clearance above the user's head. According, the user's head 210 would be completely within the breathing zone 290, and air inhaled by the user from the space above his head would similarly be from within the breathing zone. In some embodiments, the position of the upper edge 360 of the outlet area 270 may be selected based on a user 210 preference, such as a number of pillows they typically use.

Accordingly, the position of the upper edge 360 of the outlet area 270 may be selected based on a desired upper height 370 and distance 380 from the headboard 200 of the breathing zone 290. An appropriate selection may then ensure a buffer between the user 210 and the breathing zone 290 boundaries.

In some embodiments, the position of the upper edge 360 of the outlet area 270 may be adjustable by moving the upper edge of the outlet area closer or farther from the upper edge 350 of the headboard 200. Similarly, in some embodiments, the lower edge 320 of the outlet area may be adjustable as well, such that it can be aligned with a top of a mattress, pillow, or bedspread on the sleeping surface 330 of the bed 240.

The diffusor, which may include the porous surface of the outlet area 270 and/or components of the air treatment module could be installed in the headboard 200 and configured to direct the expelled clean air 220 substantially horizontally over and around the subjects' 210 head. In some embodiments, not shown, flow control and jetting could be designed to keep the flow slow and laminar around subjects' head and bodies. The flow speed typically may be maintained between 0.1 and 0.5 m/s. The collector could be located as a single inlet 260 within the foot or side of the bedframe 240 or headboard 200, or as multiple inlets spaced around or underneath the bedframe or headboard.

The flow profile described herein may create a clean air breathing zone 290 with near-zero particulates and a controlled air quality, depending on filtering. Different types of air treatment could be added to the headboard integration. This includes particulate filtering, gas filtering, heating, cooling, humidity control, oxygen control, injection or removal of other gasses, powders, scents, ions. Some of these components, such as particulate filtering, may be incorporated into the headboard 200 adjacent the porous surface of the outlet area 270, while other components, such as scent injections, may be elsewhere in the air flow path.

For example, a treatment to increase or decrease oxygen content in the air expelled by the diffusor in at least a portion of the air flow deposited into the defined space 230. Oxygen content could be increased for subjects with medical need, or decreased for athletes engaging in aerobic and cardiovascular sports wanting to simulate high altitude training during sleep. Zeolites for example can be used for effective manipulation of oxygen content. Oxygen can be stored in containers and/or generated using an oxygen concentrator.

As noted below, in some embodiments, the outlet area 270 may be split into multiple segments and different segments may serve different breathing zones 290, such as for multiple people. Accordingly, in some embodiments a plurality of air treatment modules may be provided, such that each breathing zone 290 may be provided with distinct characteristics. Accordingly, a first of the plurality of air treatment modules may increase an oxygen level in a first portion of the air flow deposited into a first breathing zone 290, and a second of the plurality of air treatment modules may not increase an oxygen level in a second portion of the air flow deposited into a second breathing zone.

Figure 3A:
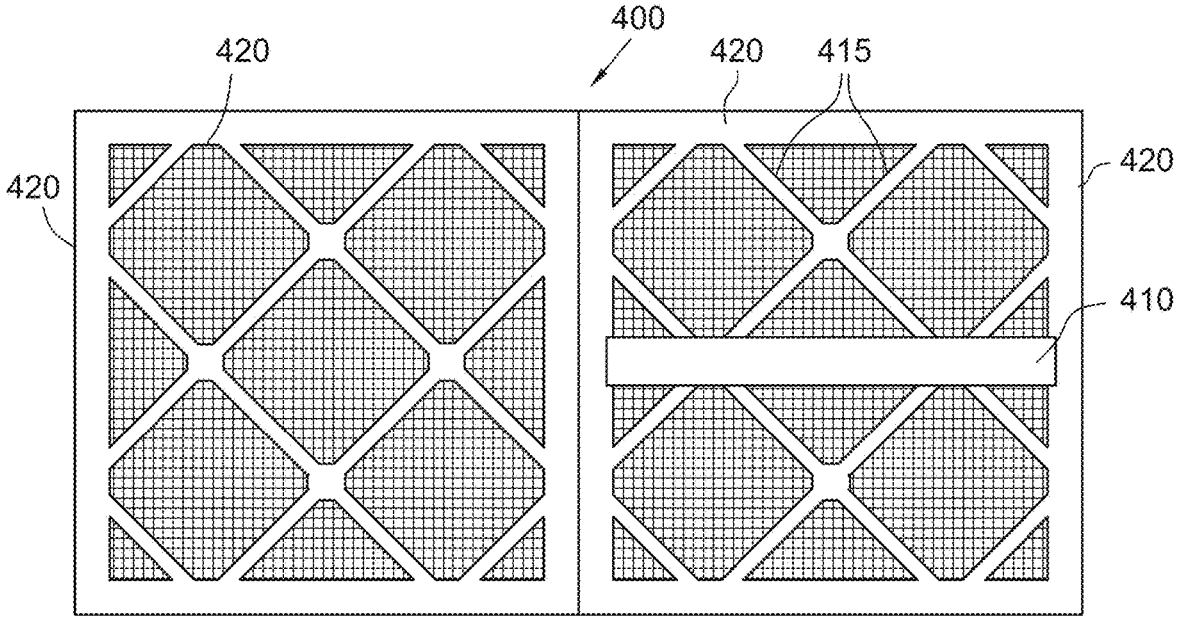
FIG. 3A illustrates a typical filtration device for use in filtering airborne contaminants from air.
Figure 3B:
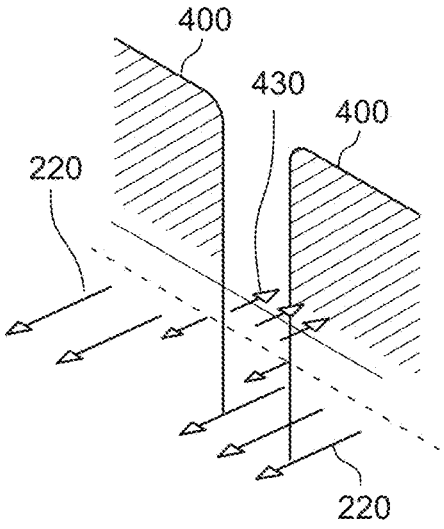
FIGS. 3B-3D illustrate repercussions of utilizing the filtration device of FIG. 3A.
Figure 3C:
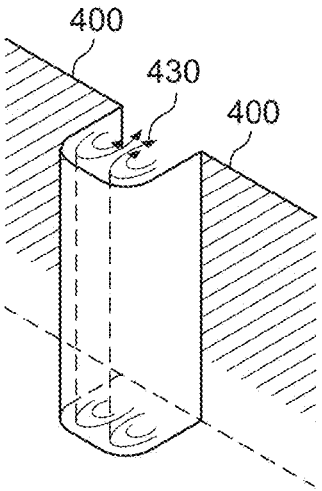
Figure 3D:
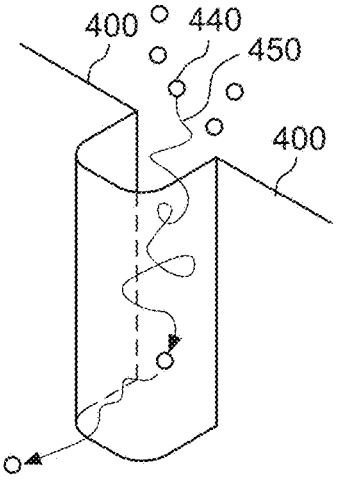

FIG. 3A illustrates a typical filtration device 400 for use in filtering airborne contaminants from air. FIGS. 3B-3D illustrate repercussions of utilizing the filtration device 400 of FIG. 3A. As shown, the typical filtration devices 400 shown have flow obstructing structures 410 of certain dimensions. For example, the filtration device 400 may take the form of a filter cassette, and as such, may include structural elements 420. Such structural elements may create wake or backflow 430. The shear between the plug flow of the filtered air flow 220 discussed above and the lack of movement directly adjacent the obstructing structure 410 thereby causes turbulence within the wake or backflow 430, and contamination 440 may then enter the airflow by way of the wake. This may provide a path 450 for the contamination 440 to enter the filtered air flow 220. The embodiments described herein are designed to avoid such contamination 440 by controlling boundary layers.

It is noted that some structural elements 415 having smaller dimensions may not obstruct flow, and therefore would not interfere with the flow path or create an opportunity for contamination.

Figure 4A:
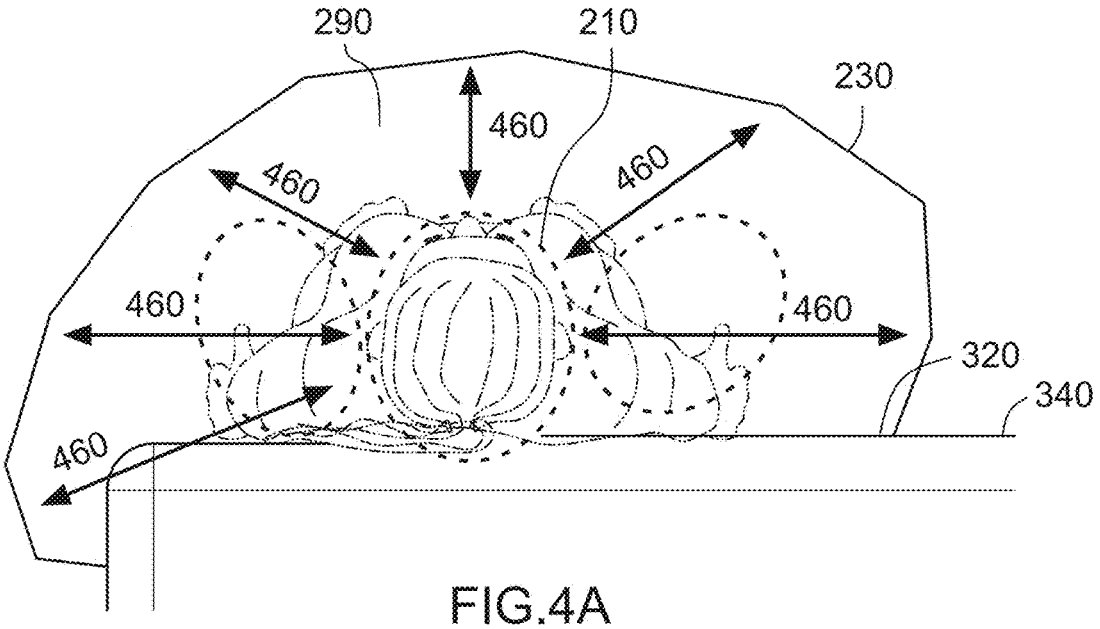
FIG. 4A illustrates an example of a defined space in accordance with this disclosure.
Figure 4B:
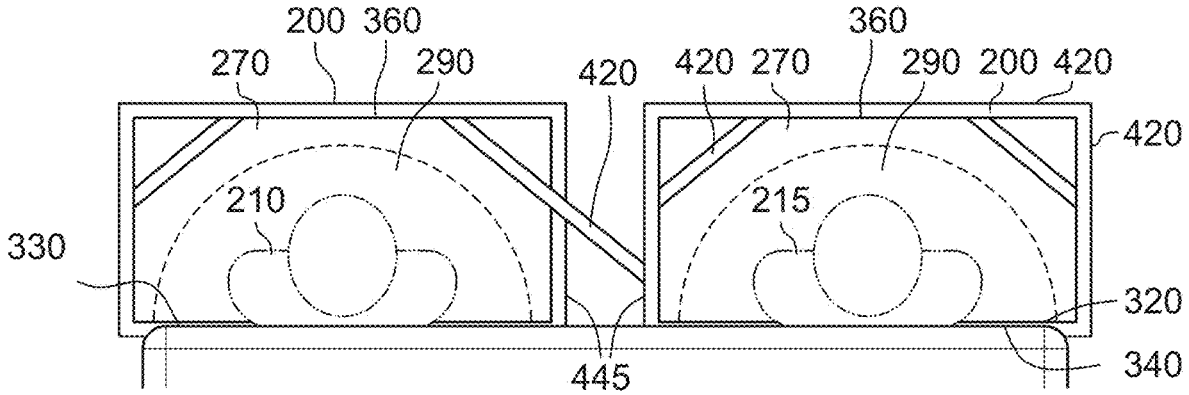
FIG. 4B illustrates an example of using an apparatus to define a defined space in accordance with this disclosure.
Figure 4C:
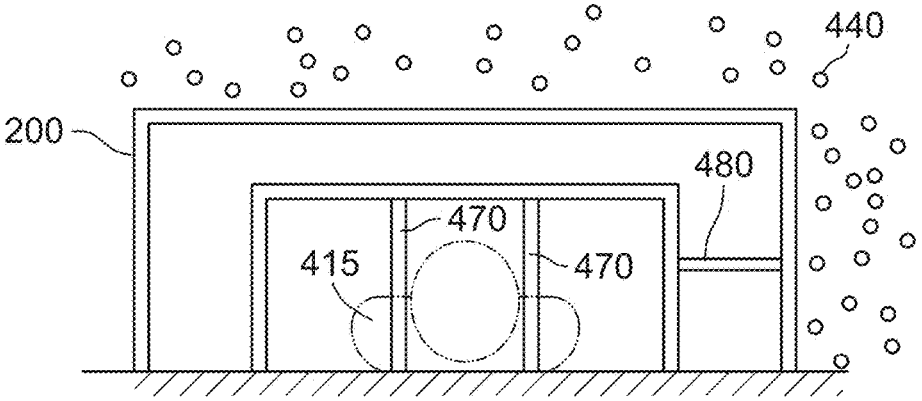
FIG. 4C illustrates an example of an apparatus including structural elements appropriately and inappropriately located.

FIG. 4A illustrates an example of a defined space 230 in accordance with this disclosure. FIG. 4B illustrates an example of using an apparatus, such as the headboard 200 of FIG. 2A, to define a defined space 230 in accordance with this disclosure. FIG. 4C illustrates an example of an apparatus, such as the headboard 200, including structural elements appropriately and inappropriately located.

As discussed above, the size and shape of the outlet area 270 may be controlled. Typically, a lower edge 320 of the outlet area 270 is aligned with an edge 340 of the sleeping surface 330. In some embodiments, the outlet area 270 may wrap around the bed 240 slightly as well. The upper edge 360 of the outlet area 270 is then located so as to provide some buffer space within the breathing zone 290 below the shear cone 310 described and shown above.

In the embodiment shown, the shape of the outlet area 270 may be modified. Minimum distances 460 between the shear cone 310 and the user 210 required to provide an appropriate buffer zone may be different in different directions. Such differences may be due to differences in shear layer stability as well as movement and positioning of the user 210. Accordingly, the upper edge 360 of the outlet area 270 may be curved or otherwise shaped. Typically, a peak of the upper edge 360 would be adjacent an expected head location of the user 210.

As shown in FIG. 4B, and as discussed above, the outlet area 270 may be divided into multiple distinct outlet areas for distinct users 210, 215, and each outlet area 270 may be substantially unobstructed other than by the porous surface and any incorporated air treatment components. Accordingly, structural elements 420 of the filter large enough to generate wake or backflow 430 are not placed within the outlet area 270 so as to avoid the entrance of contamination 440 into the breathing zone 290. In some embodiments, structural elements 415 may be located within the outlet area 270 if they are small enough to avoid wake or backflow 430, as well as if they are substantially flow aligned.

While structural elements 420 are described as components of the porous surface of the outlet area 270 or of filters integrated into such a porous surface, the outlet area may be fully integrated into the headboard 200 or plenum. As such, the structural elements 420 may be elements for supporting the plenum itself and for maintaining the porous surface in the context of the plenum. For example, a headboard may be provided with a rigid structure supporting the porous surface, such that a user 210 can lean against it.

Such structural elements 420 may then be integrated into the plenum. In some embodiments, the plenum then comprises a flow aligned support structure supporting the plenum at the outlet area 270. Such a flow aligned support structure may be, for example, a grid comprising thick components extruded in the direction of airflow. In some embodiments, the plenum may comprise additional supports 445 that are not flow aligned framing the outlet area 270. Accordingly, where two distinct segments of the outlet area 270 are provided, as shown in FIG. 4B, the outlet area may comprise two distinct outlet segments and additional support 445 that is not flow aligned may be provided to divide the two distinct outlet segments. In some such embodiments, each of the two distinct outlet segments may be independently controllable.

In constructing the embodiments described, a breathing zone 290 may be defined as a space to be kept clean of contaminants. As such, structural elements 420 should not extend into such a space. However, in some embodiments, such as that shown in FIG. 4C, the breathing zone 290 may be large enough that additional structural elements 470 are necessary to support a portion of the headboard 200. In such embodiments, structural elements 470 that are fully contained within the breathing zone 290 may be utilized. However, structural elements 480 that extend from outside of the breathing zone 290 to inside the breathing zone should be avoided, as such zones may generate wake that would allow contaminants 490 to enter the breathing zone.

Accordingly, structural elements 470 for which a total path begins and ends within the breathing zone 290 may be acceptable and structural elements 480 which extend outside of the breathing zone 290 should be avoided. Further, structural elements 420 that may interfere with the breathing zone 290 should be flow aligned, to the extent possible.

Figure 5A:
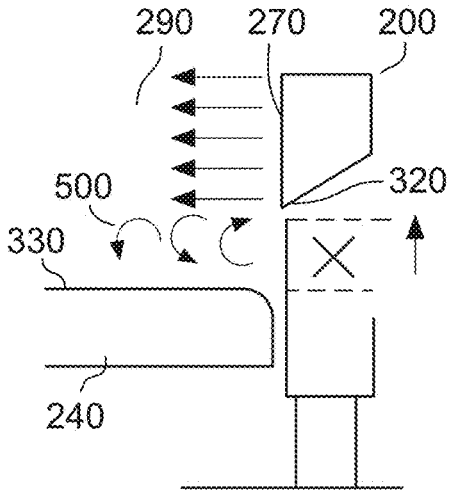
FIGS. 5A and 5B illustrate the positioning of an apparatus in accordance with this disclosure relative to a bed.
Figure 5B:
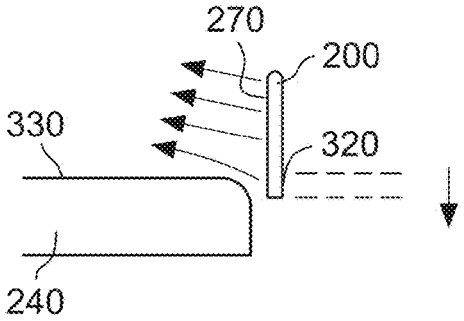
Figure 5C:
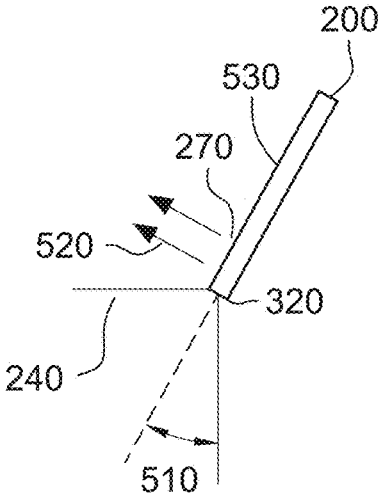
FIG. 5C illustrates an apparatus in accordance with this disclosure arranged at an angle and positioned relative to a bed.
Figure 5D:
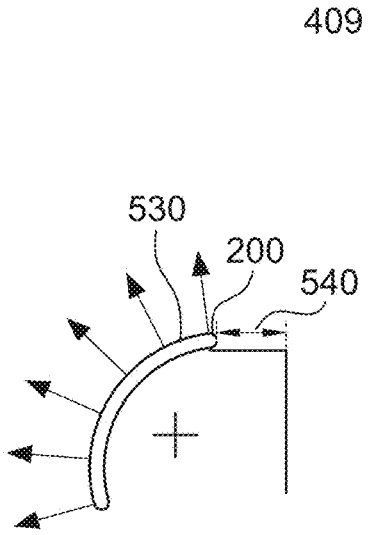
FIG. 5D illustrates another embodiment of an apparatus in accordance with this disclosure.

FIGS. 5A and 5B illustrate the positioning of an apparatus, such as a headboard 200, in accordance with this disclosure relative to a bed 240. FIG. 5C illustrates an apparatus, such as a headboard 200 in accordance with this disclosure arranged at an angle and positioned relative to a bed 240. FIG. 5D illustrates another embodiment of an apparatus, such as a headboard 200, in accordance with this disclosure.

As discussed above, the presented embodiments may be adjustable for directionality and positioning to ensure a relatively sealed clean flow. A vertical adjustment to align the lower edge 320 of the outlet area 270 with the mattress and/or pillow and/or subject is incorporated to negate the creation of mixing eddies 500 due to shear between the air flow 220 and a layer of ambient air between the breathing zone 290 and the sleeping surface 330 of the bed 240. The lower edge 320 of the outlet area 270 is then positioned such that there is no significant gap between the laminarized flow 220 and the bed 240 or other furniture or bedding. An overlap to said structures may be allowed, as shown in FIG. 5B.

In the embodiment presented in FIG. 5C, the headboard 200 is arranged such that it extends at a tilt angle 510 relative to the vertical direction. Accordingly, when the plug flow 520 extends perpendicular to the front surface 530 of the headboard 200, it extends at an angle relative to the horizontal direction. Tilt angle 510 and any overlap between the lower edge 320 of the outlet area 270 and the sleeping surface 330 are limited so as to avoid separation between the plug flow 520 and the sleeping surface 330. Such separation would create mixing and introduction of contaminants into the clean zone.

In some embodiments, the alignment may be between a 5 cm gap and a 10 cm overlap. Similarly, in some embodiments, the tilt may be between an angle 15 degrees forward and 12 degrees backward. In the embodiment shown, the angle is between 6 and 8 degrees.

Such an angled headboard 200 is shown above, for example, in FIGS. 2A-2C, and is discussed throughout this disclosure. In that embodiment, it is noted that the upper edge 360 of the outlet area 270 is located such that an expanding shear layer, or cone, 310, between the ambient air 300 and the plug flow corresponding to the breathing zone 290 remains above a user's 210 head by a threshold amount. However, because the headboard 200 is angled, the peak of the breathing zone 290 allowed by the plug flow 220 may rise after leaving the headboard. Accordingly, the upper edge 360 of the outlet area 270 may be located at a height insufficient to provide the threshold amount of clearance, but when the breathing zone extends upwards after leaving the outlet area 270, it generates the threshold amount of clearance due to the angle 510 of the headboard 200.

FIG. 5D shows an embodiment where a porous surface 530 of the outlet area functioning as a diffuser is curved. which also minimizes the optically perceived thickness 540 of the headboard 200. Curvature in multiple directions can be employed as well as simple curvature in one direction.

FIG. 6A-6D illustrate a porous surface 600 in use in the context of the apparatus, such as the headboard 200, described herein.

Figure 6A:
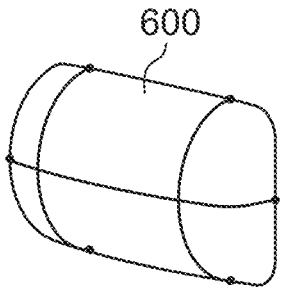
FIG. 6A-6C illustrate a porous surface in use in the context of the apparatus described herein.
Figure 6B:
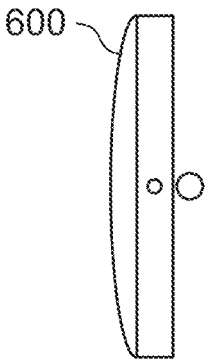
Figure 6C:
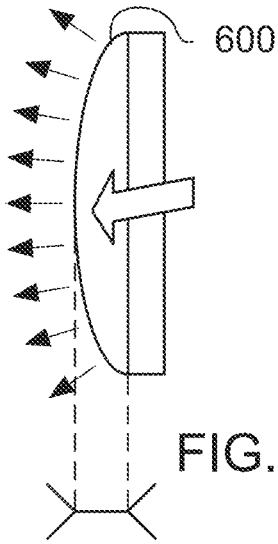

As shown in FIG. 6A, a rounded shape for the porous surface 600 may be employed to ensure a diffusive flow. This can be a rigidly supported shape, as shown in FIG. 6A, or it may be a self-regulating shape, such as that shown in FIGS. 6B-6C which is inflated and then shaped by the backpressure of the air flowing through the porous element or fabric. Accordingly, FIG. 6B shows a membrane forming the porous surface 600 without flow passing through, and FIG. 6C shows the same membrane with driving flow, thereby changing the shape of the final layer. The fabric of the membrane then bulges under the active flow which, by design, creates diverging flow.

Figure 6D:
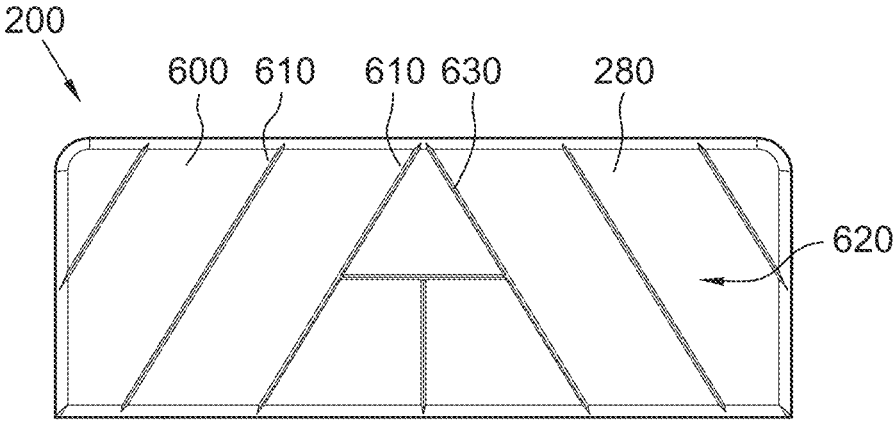
FIGS. 6D-G illustrate an alternate embodiment of a porous surface in use in the context of the apparatus described herein.
Figure 6E:
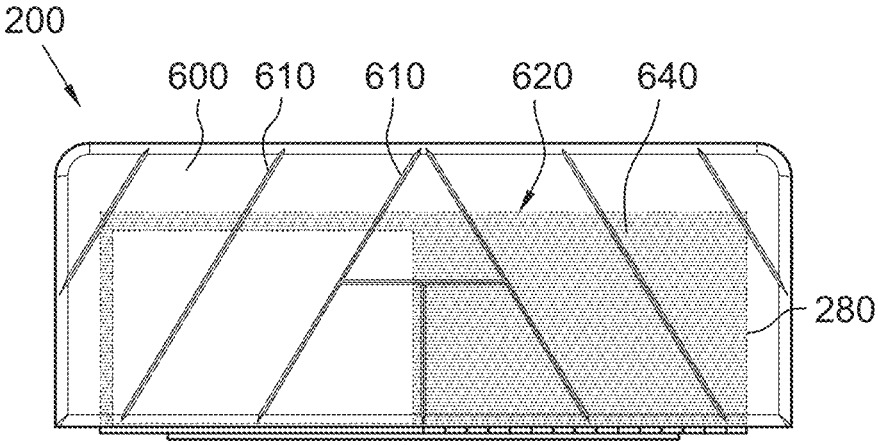

FIGS. 6D-G illustrate an alternate embodiment of a porous surface 600 in use in the context of the apparatus, such as headboard 200, described herein. As shown, in order to control the bulge of the membrane forming the porous surface 600, tension or rigid elements 610 are introduced. FIG. 6D illustrates the headboard 200 as viewed by a user 210, while FIG. 6E illustrates the headboard with an air treatment module 640, or part of an air treatment module, visible within the headboard 200. The air treatment module 640 may be located in front of the outlet area 270, while the aesthetic of the headboard 200 extends across the entire front surface 280 of the headboard.

In some embodiments of the headboard 200 where a flow aligned support structure 620 comprising rigid elements 610 is provided, the porous surface 600 of the outlet area 270 may be fixed to the flow aligned support structure. For example, in some embodiments, the porous surface 600 may be a fabric, such as a padded fabric. The fabric surface 600 may then be stitched to the flow aligned support structure 620 at visible seams 630. In some such embodiments, as shown in FIGS. 6D and 6E, the visible seams 630 may be positioned symmetrically, or otherwise positioned aesthetically, for visual effect.

Accordingly, decorative lines 630 may be provided even where significant obstructions are to be avoided. Where the visible seams 630 form decorative lines, as noted above, the aesthetic may extend fully across the front surface 280 and not be limited to the outlet area 270. In such embodiments, the outlet area 270 may be defined by an opening within the plenum which may correspond to the span of the air treatment module components 640 behind the fabric surface.

In this way, components of the air treatment module, such as filters 640, may be hidden and not visible behind the fabric surface 600.

Figure 6F:
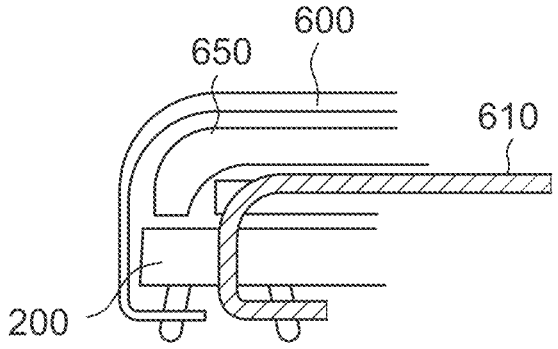
Figure 6G:
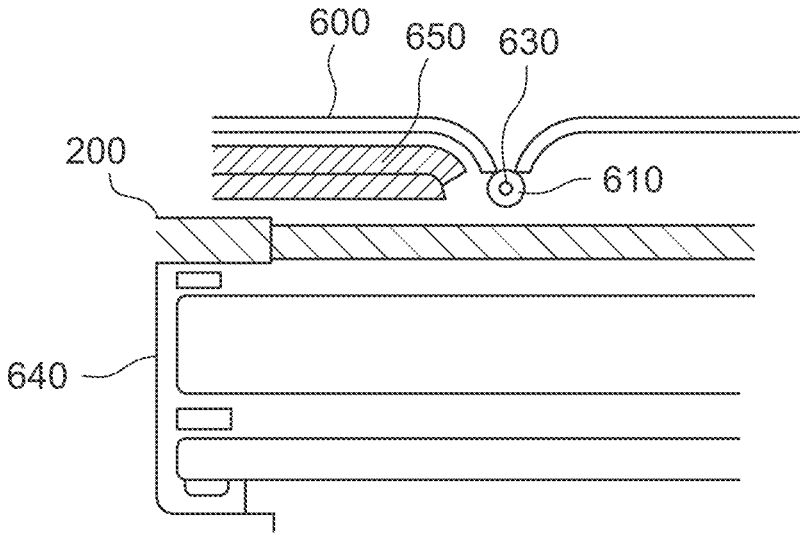

FIGS. 6F and 6G depict cross-sections through the final flow through stack. This typically includes the air treatment module 640 as well as the fabric surface 600 supported by the tensioned rigid elements 610. FIG. 6G illustrates the fixation of the fabric surface 600 to an edge of the headboard 200, while the tensioned rigid elements 610 are shown fixed to the headboard structure behind the fabric surface.

Flow straightening devices may correspond to the flow aligned support structures, and may be, for example, a hollow hexagonal or squared tubular grid structure with a length over depth ratio of larger than 2, and typically 4. This to straighten the flow, and to redirect the flow if appropriate. Air treatment means 640 such as HEPA or ULPA filter may be incorporated, as well as optional active carbon filtering and active heating or cooling elements. The tension elements, or flow aligned supports 610 can be mounted tensioned to the headboard structure 200 and can be positioned along the edge of the board or through it. Foam padding 650 that lets air through may be implemented, and fabric 600 and tension elements 610 can be fixed to the headboard 200. The fabric is designed to be porous to air with a certain resistance, typically between 20 and 150 pascals of back pressure at 0.25 m/s flow. The various components described herein, including flow straightening devices independent of the support structure 620, may be incorporated into the air treatment means 640 in addition to the filtration components.

Alternatively, in some embodiments, flow straightening devices are incorporated into the flow aligned support structure 620. Accordingly, in some embodiments, the flow aligned support 620 structure is sufficiently comprehensive and has sufficient depth to at least partially define the direction of the air flow 220. Accordingly, in some embodiments, the outlet area 270 defines an area for plug flow such that the area when extruded defines a breathing zone 290 within the defined space 230. The plug flow then extends in a direction defined by the flow aligned support structure 620. Accordingly, in some embodiments, the plug flow is not perpendicular to the front surface of the headboard 200, as the direction defined by the flow aligned support structure may be distinct from the perpendicular direction.

Figure 7A:
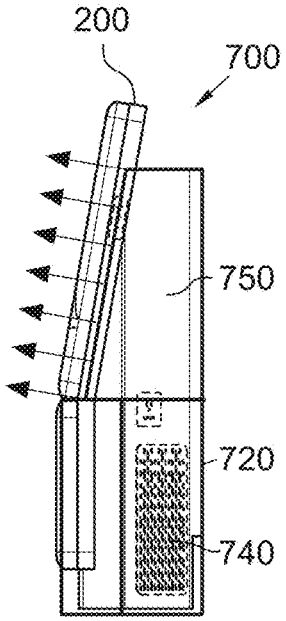
FIGS. 7A-7C illustrate a fully contained apparatus in accordance with this disclosure.
Figure 7B:
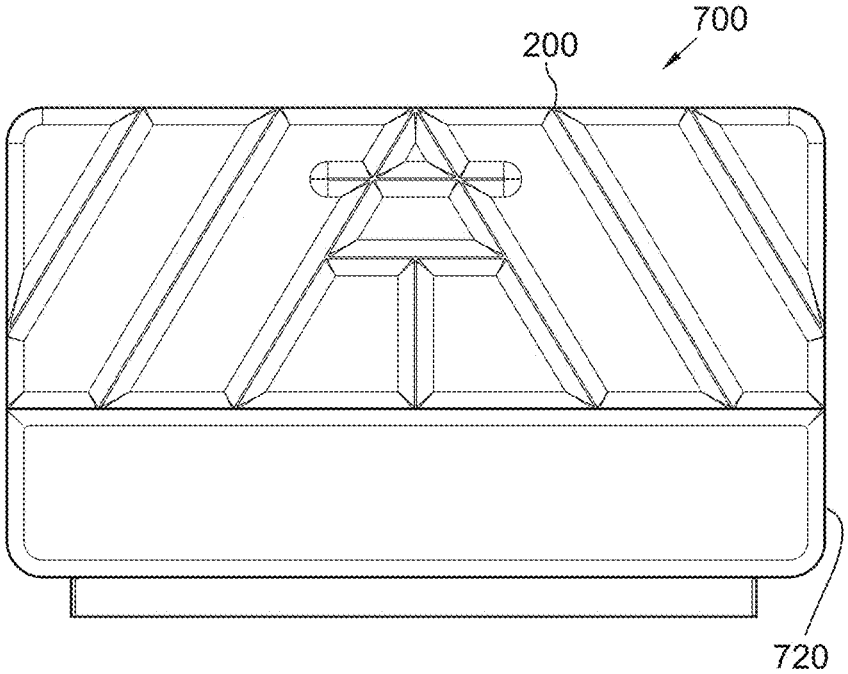
Figure 7C:
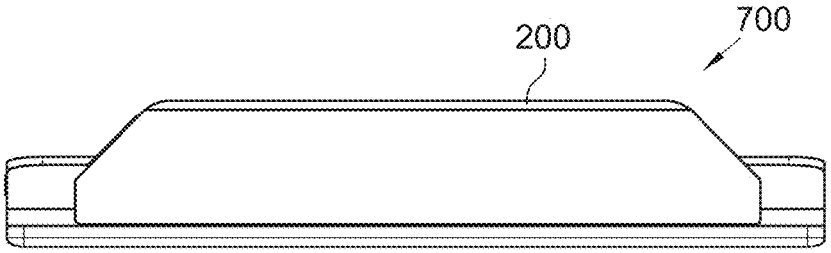
Figure 8A:
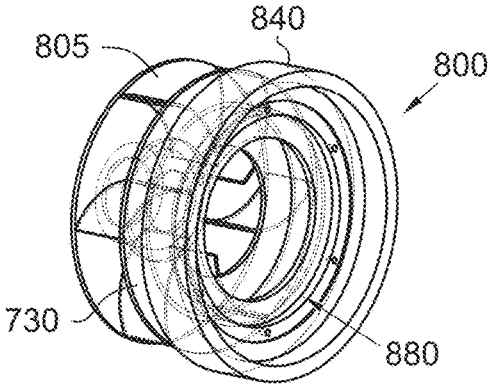
FIG. 8A illustrates a fan assembly for use in the context of the apparatus of FIG. 7A.

FIGS. 7A-7C illustrate a fully contained apparatus 700 in accordance with this disclosure. FIG. 8A illustrates a fan assembly 800 for use in the context of the apparatus 700 of FIG. 7A. FIGS. 8B-8G illustrate schematic diagrams of the apparatus 700 of FIG. 7A.

In the embodiment shown 700, the air treatment module may include a filter 710 incorporated into a base 720 of the headboard 200. Similarly, an air flow generator 730, such as a fan, may be incorporated into the base 720 of the headboard 200, typically below a height of the top surface 330 of the bed 240.

The lower conditioning or air treatment system in the example embodiment is compact in depth, typically between 28 cm and 35 cm. The air 735 is ingested at an intake 740 from a lower level near the flow to pick up cooler room air vs the ambient air at the user's height. This allows for a naturally cooling effect.

Figure 8B:
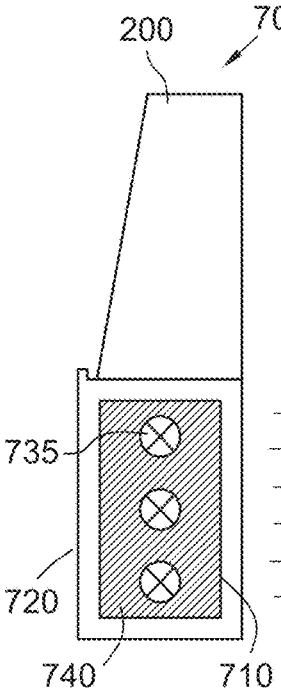
FIGS. 8B-8G illustrate schematic diagrams of the apparatus of FIG. 7A.
Figure 8C:
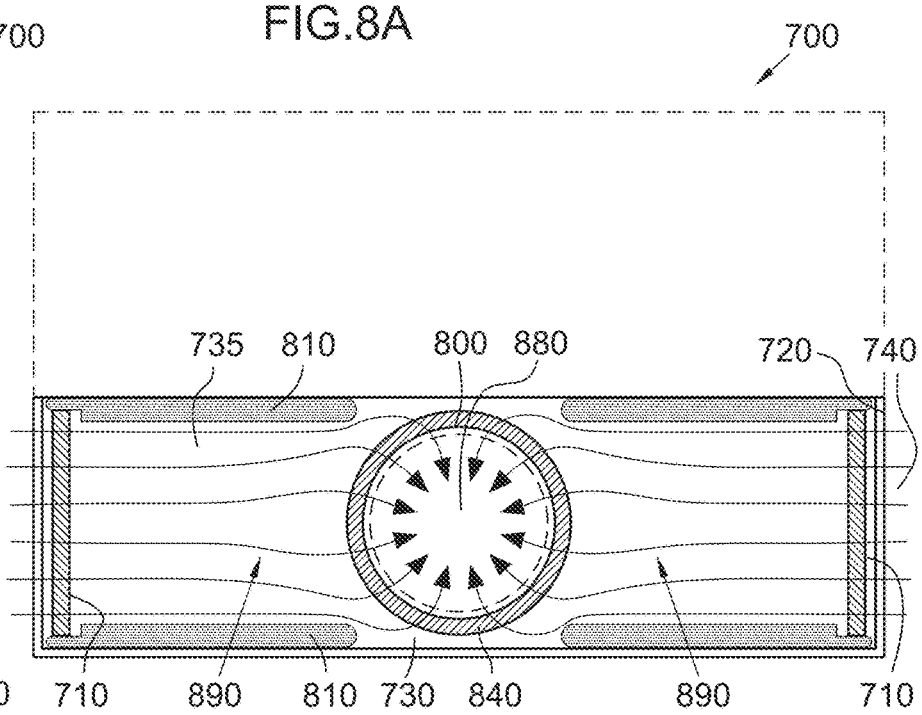
Figure 8D:
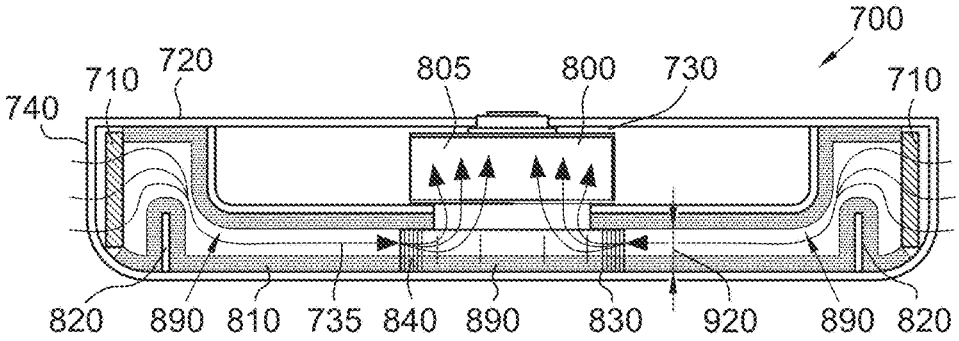

In the embodiment shown, and as discussed above, air flow ultimately exits a plenum 750 integrated into the headboard 200 and is deposited into defined space 230 containing the breathing zone 290. However, a space between a front surface 760 of the plenum 750, which may be defined by components of the air treatment module adjacent the porous surface, corresponding to the outlet area 270 and the air flow generator 730 may be obstructed by an obstruction 770, as shown in FIG. 8F. Accordingly, any air from the air flow generator passes around the obstruction 770 prior to entering the plenum 750.

As shown, the obstruction 770 may obstruct any line of sight from the plenum 750 to the air flow generator 730. This may be used to control sound levels propagating from the air flow generator 730 to the obstruction outlet area 270, so as to keep the apparatus 700 quieter from the perspective of a user 210 during use.

In some embodiments, the obstruction 770 may comprise a sequence of baffles for obstructing air flow. In other embodiments, the obstruction 770 may be a flap that opens and closes depending on need for air flow.

In the embodiment shown, the apparatus 700 comprises a secondary plenum 780 positioned between the air flow generator 730 and the obstruction 770. Accordingly, air flow from the air flow generator 730 is first deposited into the secondary plenum 780 and then proceeds from the secondary plenum to the plenum 750.

Accordingly, the assembly 700 shown has three distinct internal zones. Initially, a suction side intake section includes the intake 740 to ingest air traveling towards the air flow generator 730. A pressure side secondary plenum 780 then receives air flow from the air flow generator 730 and acts as a dampening chamber to direct flow and dampen acoustics post impeller/fan.

The headboard 200 plenum 750, which contains the porous surface used as a diffusor then receives air flow from the secondary plenum 780 and creates a controlled laminarized or low-turbulence directed plug flow in the breathing zone 290.

The diffusor, or porous surface, could be installed in the headboard 200 to direct the expelled clean air horizontally over and around the subjects' 210 head. Flow control and jetting could be designed to keep the flow slow and laminar around subjects' head and bodies as described at length above. The flow speed may be maintained between 0.1 and 0.5 m/s. The collector, or air intake 740 could be located as a single inlet within the foot or side of the bedframe or headboard, or as multiple inlets spaced around or underneath the bedframe or headboard.

In such an embodiment, the obstruction 770 may be located between the secondary plenum 780 and the plenum 750. The obstruction 770 may comprise a movable panel or movable assembly. The configuration of the movable panel 770 within the headboard 200 may then define a route taken by air flow from the air flow generator 730. As such, the configuration of the movable panel may determine a level of pressure within the plenum 750 and a level of noise detectable by the user 210 outside of the headboard 200.

In some embodiments, the obstruction 770 is passive and is responsive to a setting of the air flow generator 730. As such, when pressure in the secondary plenum 780 increases due to increased air flow from the air flow generator 730, the obstruction 770 may move to a configuration allowing more air flow to the plenum 750. Alternatively, in some embodiments, the movement of the obstruction 770, such as the movable panel, is actively controlled by a controller in order to balance pressure levels within the plenum 750 against noise levels detectable outside the headboard 200.

In some such embodiments, the apparatus 700 may further comprise a noise sensor. In such an embodiment, the movable panel may be adjusted by the controller in order to maintain the level of noise below a threshold.

In some embodiments, the controller may further control the air flow generator 730. Upon adjusting the movable panel 770 to reduce noise levels, the controller may then increase an output of the air flow generator 730 to maintain air flow at a desired level.

In the apparatus 700 provided, the air flow generator 730 therefore pressurizes the secondary plenum 780, which in turn, and in combination with the obstruction 770, controls pressure levels in the plenum 750.

As shown in FIG. 8A, the air flow generator 730 may be a centrifugal fan 800, such as a centrifugal plenum fan. FIG. 8B depicts the suction side of an embodiments of an internal structure in which the centrifugal plenum fan 800 is used. In some embodiments, the fan 800 may be run at a significantly lower speed in rpms than its design combined with an impeller is oversized for the design flow rate in order to improve acoustics.

The packaging of the apparatus minimizes the use of floorspace. Acoustic lining, or damping material, 810 can be used in the internal ducting, and a maximum flow speed (dependent on the cross-sectional flow-through area) may be set. Flow lines 735 indicate the complex convoluted path of the airflow, where a circled dot indicates flow towards the reader, and a circled X flow away from reader. The plug fan, which may be a centrifugal plenum fan 800, normally ingests from an open space, and now is blocked by a wall 830. In order to optimize flow and minimize acoustic noise due to unbalanced loading, a guide element 840 is introduced. This can be a porous element 840, perforated, tubular or with vanes in nature. The dual intakes 740 aid in evening out the flow 735. There can be a pre-filter 710 or other conditioning present upstream. Baffles 820 inserted into the airflow 850 create a complex path minimizing line-of-sight noise transmission through the filter 710.

Figure 8E:
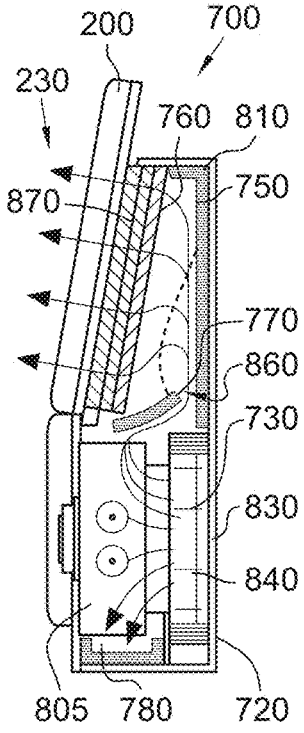
Figure 8F:
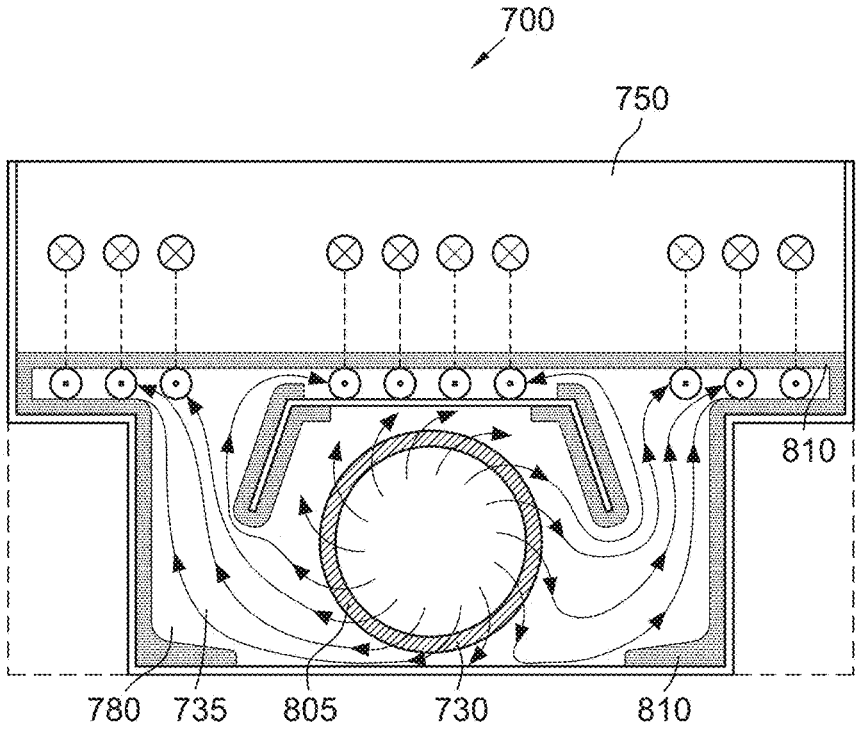
Figure 8G:
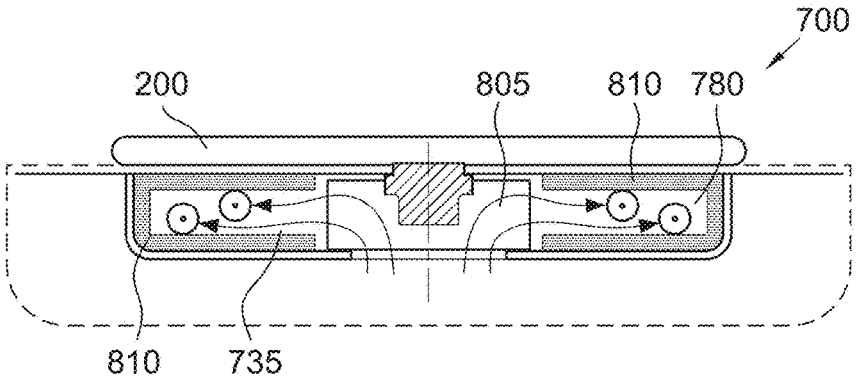

In FIGS. 8E-G, side, front, and top cross section views of the apparatus 700 are provided. The discharge flow path 735 from the fan 800 is thereby illustrated. The passage is optimized to balance structural dimensions with pressure drop and acoustics.

A discharge channel is designed to minimize acoustic noise to the subjects by having a semi-enclosed space that can be lined with acoustic dampening material 810. The opening 860 into the final plenum 750 is designed such that there is enough room and distance for each point of the final resistor stack 870, consisting of filters and/or flow straighteners integrated into the porous material of the plenum 750, to have substantially equal flow direction and velocity when exiting. The final resistor stack 870 combines with the pre-filter 710 and any other air treatment components to function as the air treatment module 640. Note that different chambers/plenums are created and that for acoustics, line of sight are blocked as much as possible. A double plenum system is created to have a compact body as well as an acoustic shielding. Two or more distinct plenum chambers can be identified, and include the primary plenum 750 and the secondary plenum 780.

In some embodiments, a resistance structure may be implemented to aid in the distribution of flow. The flow gets blocked and deflected, creating a labyrinth-like flow. A convoluted flow path is created, moving in multiple directions and not in a single plane. Such a convoluted flow path may include the obstruction 770 discussed above.

Accordingly, as noted above, in some embodiments, the air flow generator 730 is a centrifugal fan 800. In such an embodiment, the intake for the fan may be fluidically connected to the intake section 740 of the apparatus 700. A centrifugal wheel 805 of the centrifugal fan 800 may then be located within the secondary plenum 780, such that the fan 800 deposits the air flow, or pressurizes air, within the secondary plenum.

In the embodiment shown, the air flow generator 730 is a centrifugal fan 800 with an axial intake 880. Air flow is then directed from the air flow inlet 740 to the axial intake 880 in a conduit 890 having a direction substantially perpendicular to an axis 900 of the centrifugal fan 800. The axial intake 880 is then spaced apart from a back wall 830 of the conduit 890 by a first distance 920.

The air flow generator 730 may then be provided with a guide element 840, as noted above. The guide element 840 may redirect air flow in the conduit 890 such that portions of the air flow approach the axial intake from directions other than the direction of the conduit.

As shown in FIG. 8A, the guide element 840 may be a porous or perforated cylindrical shroud that extends across the first distance 920. Accordingly, any air flow that enters the axial intake 880 may first pass through the cylindrical shroud. Alternatively, in some embodiments, the guide element 840 may comprise a plurality of vanes for directing air flow substantially evenly about the axial intake 880.

The fan 800 and corresponding assembly itself may be provided in alternative embodiments of the apparatus 700 described, as well as in other contexts requiring a plenum fan or the like but without sufficient space adjacent the intake Such a fan assembly 800 includes a centrifugal outlet, such as a centrifugal wheel 805, an axial intake 880, an intake conduit 890 extending substantially perpendicular to the axial intake, and a guide element 840 for redirecting air flow adjacent the axial intake 880.

The axial intake 880 is spaced apart from a back wall 910 of the intake conduit 890 by a first distance 920. The guide element 840 then redirects air flow such that portions of the air flow approach the axial intake 880 from directions other than a direction of the intake conduit 890. As noted above, the guide element 840 may be a porous or perforated cylindrical shroud that extends across the first distance 920. Alternatively, the guide element 840 may be a plurality of vanes for directing air flow substantially evenly about the axial intake.

As discussed above, the fan may be run at a significantly lower rpms than it would if it were a standard fan design. Further, an oversized impeller for the design flow rate may be incorporated, such that the fan can turn slowly while still moving air in order to improve acoustics. For example, a fan with a 50-100% larger diameter compared to an equivalent fan for the flow and pressure drop can be employed running at a lower rpm to obtain target flow. This rpm for example can be below 1000 rpm or 30-60% of the fan design speed. For example, a 350 mm or 400 mm diameter plenum fan running at 900 rpm can be used instead of a 220 mm fan running at 2300 rpm. The packaging of the system minimizes the use of horizontal space.

Figure 9:
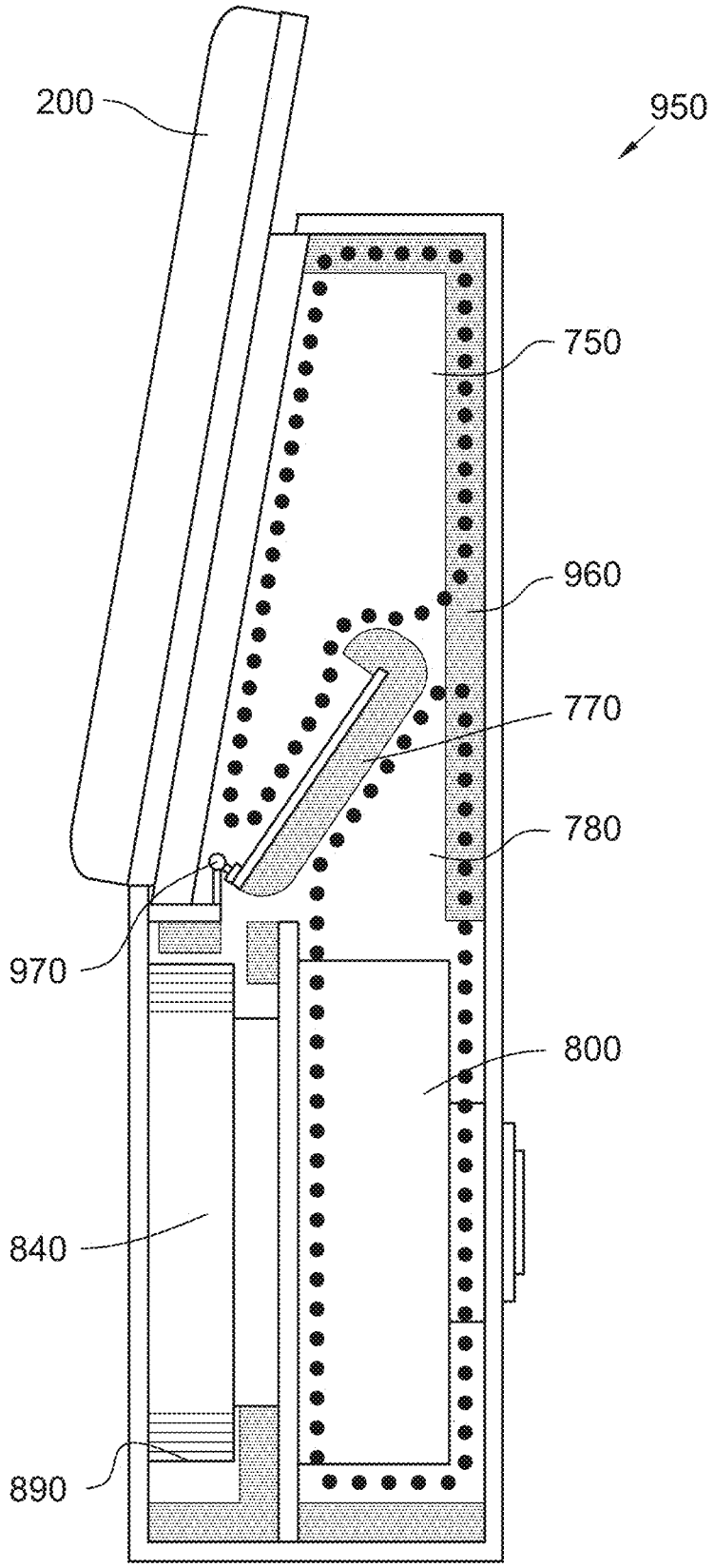
FIG. 9 illustrates an alternative embodiment of a fully contained apparatus in accordance with this disclosure.

FIG. 9 illustrates an alternative embodiment of a fully contained apparatus 950 in accordance with this disclosure. As shown, the exhaust from the fan 800 is in again in the form of a dual plenum 750, 780, where a secondary plenum 780 is for controlling the fan flow and acoustics and pre-distributing, and primary plenum 750 provides a final flow distribution. A narrowing passage 960 is created between the two plenum regions using an obstruction 770. A hinge 970 can be incorporated to actively control the balance between pressure drop and acoustics. A hinged lid, functioning as an obstruction 770 could be actuated passively or actively to balance back-pressure with acoustics. A controller can sense relevant parameters and adjust this. The hinged lid 770 can also be passively driven by balancing forces between gravity and air pressure due to flow in the passage 960.

It is noted that in the embodiment of FIG. 9, the locations of the secondary plenum 780 and the intake conduit 890 have been switched, such that the intake is adjacent a bed 240 and the secondary plenum is adjacent a back surface of the apparatus 950.

Figure 10A:
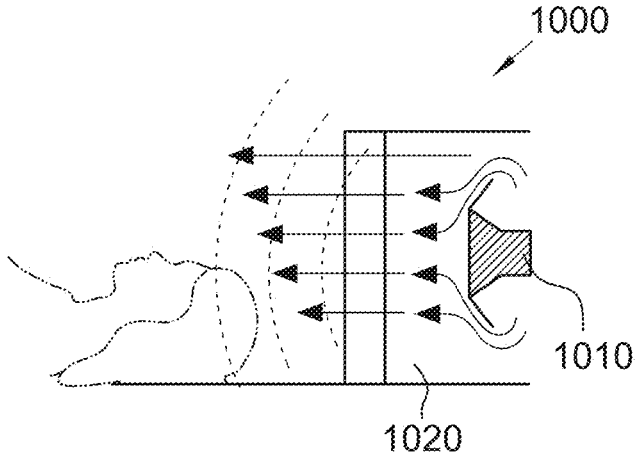
FIG. 10A illustrates an embodiment of an apparatus in accordance with this disclosure containing additional features.

FIG. 10A illustrates an embodiment of an apparatus 1000 in accordance with this disclosure containing additional features. As shown, the apparatus 1000 may incorporate a speaker or sound system 1010 located in the plenum 1020. This speaker 1010 can play music or other content, or provide a white or pink noise signal or other soothing sounds. It can function as an alarm clock. Active noise control of the plenum 1020 is possible as well. Part of the volume of the plenum can be used for sound tuning of for example base sounds.

Figure 10B:
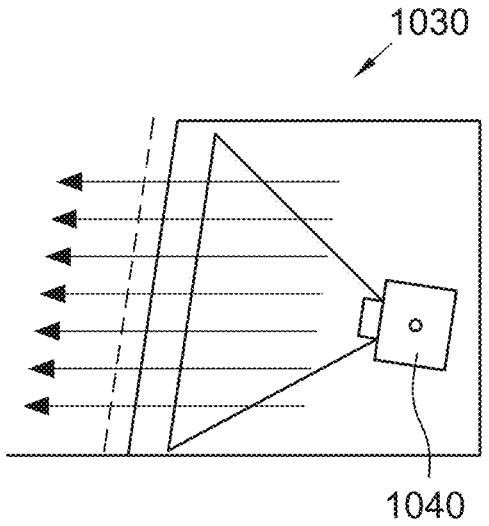
FIG. 10B illustrates an alternative embodiment of an apparatus in accordance with this disclosure containing additional features.

FIG. 10B illustrates an alternative embodiment of an apparatus 1030 in accordance with this disclosure containing additional features. FIG. 10B shows that a projection device or light source 1040 can be used, where light, video, photo material and the like can be projected onto or through the diffuser.

Figure 10C:
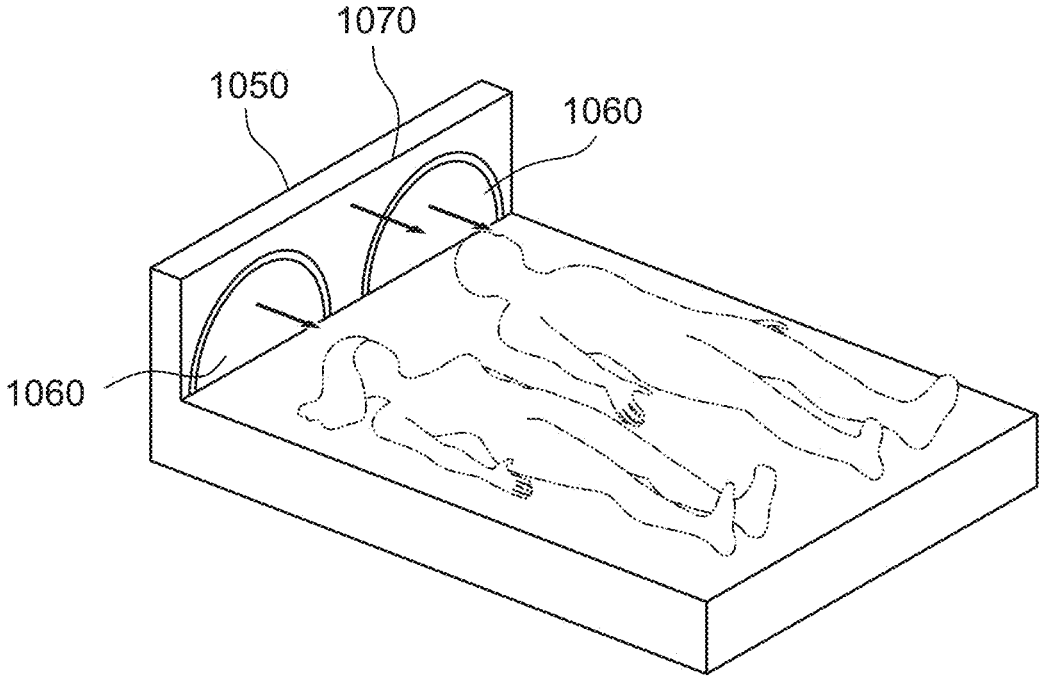
FIG. 10C illustrates an alternative embodiment of an apparatus in accordance with this disclosure containing two zones and additional features.

FIG. 10C illustrates an alternative embodiment of an apparatus 1050 in accordance with this disclosure containing two zones and additional features. FIG. 10C shows an embodiment where there are local different zone 1060 within the main diffuser 1070 where properties can be different. For example, injection of a gas or other agent, different air composition, different flow. This can help save oxygen for example. Oxygen content could be increased for subjects with medical need, or decreased for athletes engaging in aerobic and cardiovascular sports wanting to simulate high altitude training during sleep. Zeolites for example can be used for effective manipulation of oxygen content. Oxygen can be stored in containers and/or generated using an oxygen concentrator. For example, a treatment to increase or decrease oxygen content in the air expelled by the diffusor.

Figure 10D:
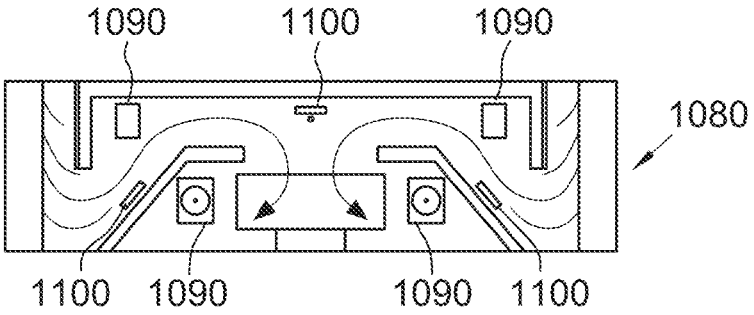
FIGS. 10D and 10E illustrate an alternative embodiment of an apparatus in accordance with this disclosure containing additional features.
Figure 10E:
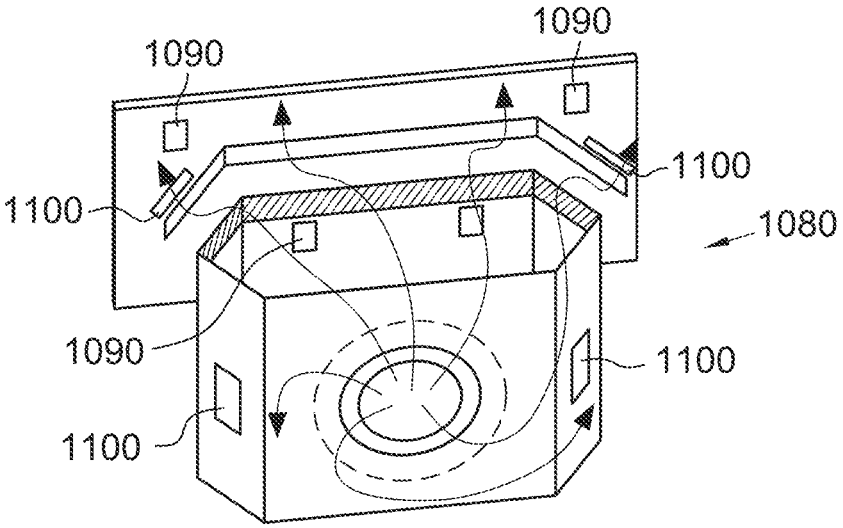

FIGS. 10D and 10E illustrate an alternative embodiment of an apparatus 1080 in accordance with this disclosure containing additional features. Active noise control may be provided using a dual plenum chamber design, as discussed above. The sensing elements 1090 with different outline shapes, and actuator sets 1100 may be provided. The volumes each have their sensors and actuators, whilst data from each can be used with a controller for cross-over in other volumes as well.

Figure 10F:
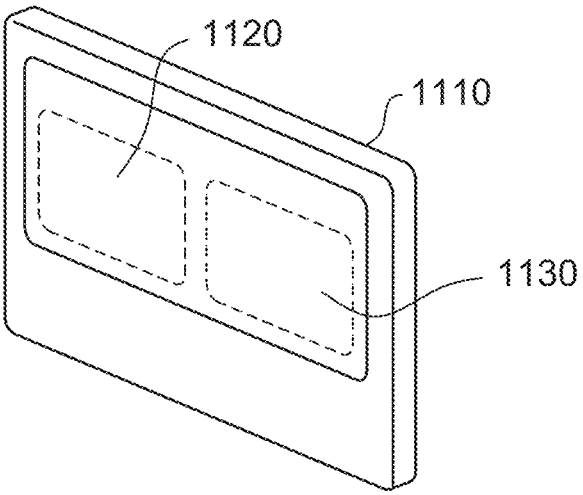
FIG. 10F illustrates a dual zone embodiment of an apparatus in accordance with this disclosure.

FIG. 10F illustrates a dual zone embodiment 1110 of an apparatus in accordance with this disclosure. Each of the zones 1120, 1130, may be controlled individually.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An apparatus for removing airborne contaminants from a defined space above a bed comprising:

a headboard for a bed comprising an air flow outlet adjacent to the defined space;

an air flow inlet incorporated into the bed or the headboard outside of the defined space;

a conduit for transporting air from the air flow inlet to the air flow outlet;

an air treatment module within or adjacent the conduit for extracting airborne contaminants from air transported from the air flow inlet to the air flow outlet;

an air flow generator within or adjacent the conduit for generating air flow between the air flow inlet and the air flow outlet, wherein the air flow outlet comprises a plenum within the headboard, and wherein the plenum deposits air into the defined space through an outlet area having a porous surface, the outlet area being otherwise unobstructed, wherein the plenum comprises a support structure and wherein the porous surface is fixed to the support structure, wherein the support structure comprises support elements that are sufficiently narrow or flow aligned so as to not obstruct air flow, and wherein the porous surface is a padded fabric surface, and wherein the fabric surface is fixed to the support structure at visible seams.

2. The apparatus of claim 1, wherein the outlet area defines an area for a plug flow, such that the area when extruded contains a breathing zone within the defined space, and wherein the plug flow extends perpendicular to a front surface of the headboard into the breathing zone.

3. The apparatus of claim 2, wherein the breathing zone is adjacent a sleeping surface of the bed, and wherein a lower edge of the outlet area is aligned with an edge of the sleeping surface.

4. The apparatus of claim 2, wherein the headboard extends at an angle relative to a vertical direction, such that when the plug flow extends perpendicular to the front surface of the headboard, the plug flow extends at an angle relative to a horizontal direction.

5. The apparatus of claim 1, wherein the plenum comprises rigid supports for supporting a housing of the headboard, and wherein the rigid supports frame the outlet area, such that the unobstructed area is not obstructed with supports.

6. The apparatus of claim 1, wherein the plenum comprises a flow aligned support structure supporting the plenum at the outlet area.

7. The apparatus of claim 1, wherein the support elements are tension elements, and wherein the visible seams are positioned symmetrically along the headboard for visual effect.

8. The apparatus of claim 1, wherein support components of the support structure are fully contained within the outlet area and do not extend to a top or side edge of the outlet area.

9. The apparatus of claim 1 wherein the air treatment module further comprises an oxygenation module for increasing an oxygen level in at least a portion of the air flow deposited into the defined space.

10. The apparatus of claim 9, wherein a plurality of air treatment modules is provided, and wherein a first of the plurality air treatment modules increases an oxygen level in the at least a portion of the air flow deposited into the defined space, and wherein a second of the plurality of air treatment modules does not increase an oxygen level in a second portion of the air flow deposited into the defined space.

11. The apparatus of claim 1, wherein the air flow generator is incorporated into a base of the headboard below a height of a top surface of the bed.

12. The apparatus of claim 11, wherein a space between a front surface of the plenum and the air flow generator is obstructed by an obstruction, such that air from the air flow generator passes around the obstruction prior to entering the plenum.

13. The apparatus of claim 1:

wherein the air flow generator is incorporated into a base of the headboard below a height of a top surface of the bed, wherein a space between a front surface of the plenum and the air flow generator is obstructed by an obstruction, such that air from the air flow generator passes around the obstruction prior to entering the plenum, wherein the apparatus further comprises a secondary plenum positioned between the air flow generator and the obstruction, such that air flow from the air flow generator is deposited into the secondary plenum and then proceeds from the secondary plenum to the plenum, and wherein the secondary plenum comprises an air distribution module having vanes, and wherein the air distribution module determines a distribution of air deposited into the plenum from the secondary plenum.

14. The apparatus of claim 1 wherein the air flow generator is incorporated into a base of the headboard below a height of a top surface of the bed, wherein a space between a front surface of the plenum and the air flow generator is obstructed by an obstruction, such that air from the air flow generator passes around the obstruction prior to entering the plenum, wherein the apparatus further comprises a secondary plenum positioned between the air flow generator and the obstruction, such that air flow from the air flow generator is deposited into the secondary plenum and then proceeds from the secondary plenum to the plenum, wherein the obstruction is between the secondary plenum and the plenum, and wherein the obstruction comprises a movable panel, and wherein a configuration of the movable panel within the headboard defines a route taken by air flow from the air flow generator.

15. The apparatus of claim 14, wherein the configuration of the movable panel determines a level of pressure within the plenum and a level of noise detectable outside the headboard.

16. The apparatus of claim 14, wherein movement of the movable panel is passive and is responsive to a setting of the air flow generator.

17. The apparatus of claim 14, wherein movement of the movable panel is actively controlled by a controller in order to balance pressure levels within the plenum against noise levels detectable outside the headboard.

18. The apparatus of claim 17 further comprising at least one noise sensor, and wherein the movable panel is adjusted by the controller in order to maintain the level of noise below a threshold.

19. The apparatus of claim 17, wherein the controller further controls the air flow generator, and wherein upon adjusting the movable panel to reduce noise levels, the controller increases an output of the air flow generator to maintain air flow at a desired level.

20. The apparatus of claim 1:

wherein the air flow generator comprises a centrifugal fan with an axial intake, wherein air flow from the air flow inlet is directed to the axial intake in a conduit having a direction substantially perpendicular to an axis of the centrifugal fan, and wherein the axial intake is spaced apart from a back wall of the conduit by a first distance, wherein the air flow generator further comprises a guide element for redirecting air flow in the conduit such that portions of the air flow approach the axial intake from directions other than the direction of the conduit, and wherein the guide element is a porous or perforated cylindrical shroud that extends across the first distance, such that air flow that enters the axial intake first passes through the cylindrical shroud.

21. The apparatus of claim 1:

wherein the air flow generator comprises a centrifugal fan with an axial intake, wherein air flow from the air flow inlet is directed to the axial intake in a conduit having a direction substantially perpendicular to an axis of the centrifugal fan, and wherein the axial intake is spaced apart from a back wall of the conduit by a first distance, wherein the air flow generator further comprises a guide element for redirecting air flow in the conduit such that portions of the air flow approach the axial intake from directions other than the direction of the conduit, and wherein the guide element comprises a plurality of vanes for directing air flow substantially evenly about the axial intake.

* * * * *